US010695629B2

(12) United States Patent
Petersen et al.

(10) Patent No.: US 10,695,629 B2
(45) **Date of Patent: *Jun. 30, 2020**

(54) GOLF CLUB HEADS WITH CAVITIES AND INSERTS AND RELATED METHODS

(71) Applicant: KARSTEN MANUFACTURING CORPORATION, Phoenix, AZ (US)

(72) Inventors: David L. Petersen, Peoria, AZ (US); Les J. Bryant, Peoria, AZ (US); James D. Glover, Sun City, AZ (US); Richard D. MacMillan, Glendale, AZ (US); Xiaojian Chen, Phoenix, AZ (US); Martin R. Jertson, Cave Creek, AZ (US); Yujen Huang, Pingtung (TW); Jacob T. Clarke, Phoenix, AZ (US); Tyler A. Shaw, Paradise Valley, AZ (US); William D. Shearer, Phoenix, AZ (US); Travis D. Milleman, Portland, OR (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/444,298

(22) Filed: Jun. 18, 2019

(65) Prior Publication Data

US 2019/0329107 A1 Oct. 31, 2019

Related U.S. Application Data

(63) Continuation of application No. 15/945,666, filed on Apr. 4, 2018, now Pat. No. 10,363,466, and a (Continued)

(51) Int. Cl.
*A63B 53/08* (2015.01)
*A63B 53/04* (2015.01)
(Continued)

(52) U.S. Cl.
CPC ..... *A63B 53/08* (2013.01); *A63B 53/047* (2013.01); *A63B 53/06* (2013.01); *A63B 60/02* (2015.10);
(Continued)

(58) Field of Classification Search
CPC ..... A63B 53/08; A63B 53/047; A63B 60/54; A63B 53/06; A63B 60/02;
(Continued)

(56) References Cited

U.S. PATENT DOCUMENTS 4,630,825 A 12/1986 Schmidt et al.
5,190,290 A 3/1993 Take
(Continued)

FOREIGN PATENT DOCUMENTS

EP 0622094 3/1994
JP 1133147 2/1999

OTHER PUBLICATIONS

International Search Report/Written Opinion, PCT Application No. PCT/US2017/026055, dated Jun. 8, 2017.

*Primary Examiner* — Sebastiano Passaniti

(57) ABSTRACT

Golf club heads with cavities and inserts, and methods to manufacture golf club heads with cavities. Various embodiments include a golf club head comprising a body. The body comprises a strikeface at a front of the golf club head, a backface opposite the strikeface, a heel region, a toe region opposite the heel region, a sole, a rear portion at a rear of the golf club head, and a cavity located between the backface and the rear portion. In many embodiments, the body further comprises an insert within the cavity.

20 Claims, 15 Drawing Sheets

Related U.S. Application Data continuation-in-part of application No. 15/479,049, filed on Apr. 4, 2017, now Pat. No. 10,022,601.

(60) Provisional application No. 62/620,330, filed on Jan. 22, 2018, provisional application No. 62/481,503, filed on Apr. 4, 2017, provisional application No. 62/407,736, filed on Oct. 13, 2016, provisional application No. 62/318,047, filed on Apr. 4, 2016.

(51) Int. Cl.
*A63B 60/54* (2015.01)
*A63B 53/06* (2015.01)
*A63B 60/02* (2015.01)

(52) U.S. Cl.
CPC ..... *A63B 60/54* (2015.10); *A63B 2053/0408* (2013.01); *A63B 2053/0491* (2013.01); *A63B 2209/00* (2013.01)

(58) Field of Classification Search
CPC ..... A63B 2053/0408; A63B 2209/00; A63B 2053/0491
USPC ..... 473/324–350, 287–292
See application file for complete search history.

(56) References Cited

U.S. PATENT DOCUMENTS

| | | | | |
|---|---|---|---|---|
| 5,720,673 | A | 2/1998 | Anderson | |
| 5,749,794 | A | 5/1998 | Kobayashi et al. | |
| 5,833,551 | A | 11/1998 | Vincent et al. | |
| 5,863,261 | A | 1/1999 | Eggiman | |
| 5,913,735 | A | 6/1999 | Kenmi | |
| 6,319,149 | B1 | 11/2001 | Lee | |
| 6,562,469 | B2 | 7/2003 | Gilbert | |
| 6,592,468 | B2 | 7/2003 | Vincent et al. | |
| 6,592,469 | B2 | 7/2003 | Gilbert | |
| 6,743,114 | B2 | 6/2004 | Best | |
| 6,896,627 | B2 | 5/2005 | Hou | |
| 6,921,344 | B2 | 7/2005 | Gilbert et al. | |
| D547,410 | S | 7/2007 | Nicolette et al. | |
| 7,485,049 | B2 | 2/2009 | Gilbert et al. | |
| 7,601,077 | B2 | 10/2009 | Serrano et al. | |
| 7,789,771 | B2 | 9/2010 | Park et al. | |
| 7,811,180 | B2 | 10/2010 | Roach et al. | |
| 7,815,523 | B2 | 10/2010 | Knutson et al. | |
| 7,976,403 | B2 * | 7/2011 | Gilbert | A63B 53/0475 473/309 |
| 8,221,263 | B2 | 7/2012 | Tavares et al. | |
| 8,277,337 | B2 | 10/2012 | Shimazaki | |
| 8,517,859 | B2 | 8/2013 | Golden et al. | |
| 8,690,710 | B2 | 4/2014 | Nicolette et al. | |
| 8,758,163 | B2 | 6/2014 | Stites | |
| 8,801,540 | B2 | 8/2014 | Hebreo et al. | |
| 9,283,448 | B2 | 3/2016 | Sander | |
| 9,358,432 | B2 | 6/2016 | Boggs | |
| 9,370,697 | B2 | 6/2016 | Beno et al. | |
| 9,545,548 | B2 | 1/2017 | Peterson et al. | |
| 9,623,296 | B2 | 4/2017 | Nicolette et al. | |
| 10,022,601 | B2 | 7/2018 | Peterson et al. | |
| 10,300,355 | B2 * | 5/2019 | Petersen | A63B 53/0475 |
| 10,343,035 | B2 * | 7/2019 | Chen | A63B 53/0475 |
| 10,363,466 | B2 * | 7/2019 | Petersen | A63B 53/047 |
| 10,420,991 | B2 * | 9/2019 | Petersen | A63B 60/54 |
| 2003/0092502 | A1 | 5/2003 | Pergande et al. | |
| 2005/0148407 | A1 | 7/2005 | Gilbert et al. | |
| 2006/0025234 | A1 * | 2/2006 | Nicolette | A63B 53/047 473/334 |
| 2007/0155534 | A1 | 7/2007 | Tsai et al. | |
| 2011/0151997 | A1 | 6/2011 | Shear | |
| 2011/0250985 | A1 | 10/2011 | Stites | |
| 2012/0100925 | A1 | 4/2012 | Soracco et al. | |
| 2014/0274455 | A1 | 9/2014 | Jertson et al. | |
| 2017/0028271 | A1 | 2/2017 | Petersen et al. | |

* cited by examiner

GOLF CLUB HEADS WITH CAVITIES AND INSERTS AND RELATED METHODS

CROSS REFERENCE TO RELATED APPLICATIONS

This is a continuation of U.S. patent application Ser. No. 15/945,666 filed Apr. 4, 2018, which is a continuation-in-part of U.S. patent application Ser. No. 15/479,049, filed Apr. 4, 2017, now U.S. Pat. No. 10,022,601 issued Jul. 17, 2018, which claims priority to U.S. Provisional Application No. 62/407,736, filed Oct. 13, 2016, and U.S. Provisional Application No. 62/318,047, filed Apr. 4, 2016. This further claims priority to U.S. Provisional Application No. 62/481,503, filed Apr. 4, 2017 and U.S. Provisional Application No. 62/620,330, filed Jan. 22, 2018. The contents of all of the above-described applications are incorporated fully herein by reference.

TECHNICAL FIELD

This disclosure relates generally to golf clubs, and relates more particularly to golf club heads with cavities and inserts.

BACKGROUND

Golf club manufacturers have designed golf club heads to accommodate the general preferences of its users as well as the individual user's golfing ability. Some golf club manufacturers also have designed golf club heads to accommodate the preferences of an individual user, such as an individual's preference for the golf club head's look and feel. Some golf club manufacturers also have designed golf club heads to accommodate other events associated with golf play. For example, some individuals dislike feeling vibrations in the golf club after hitting a golf ball. Thus, some golf club heads may be designed to lessen the undesirable vibrations during play, while maintaining elements to assist the individual with his/her game. Some golf club heads comprise an insert within a cavity of the golf club head in order to lessen the undesirable vibrations during play. However, the insert within the cavity can become dislodged within the cavity during impact. Therefore, an insert that can mechanically secure into the cavity to prevent dislodging is manufactured.

BRIEF DESCRIPTION OF THE DRAWINGS

To facilitate further description of the embodiments, the following drawings are provided in which.

Figure 1:
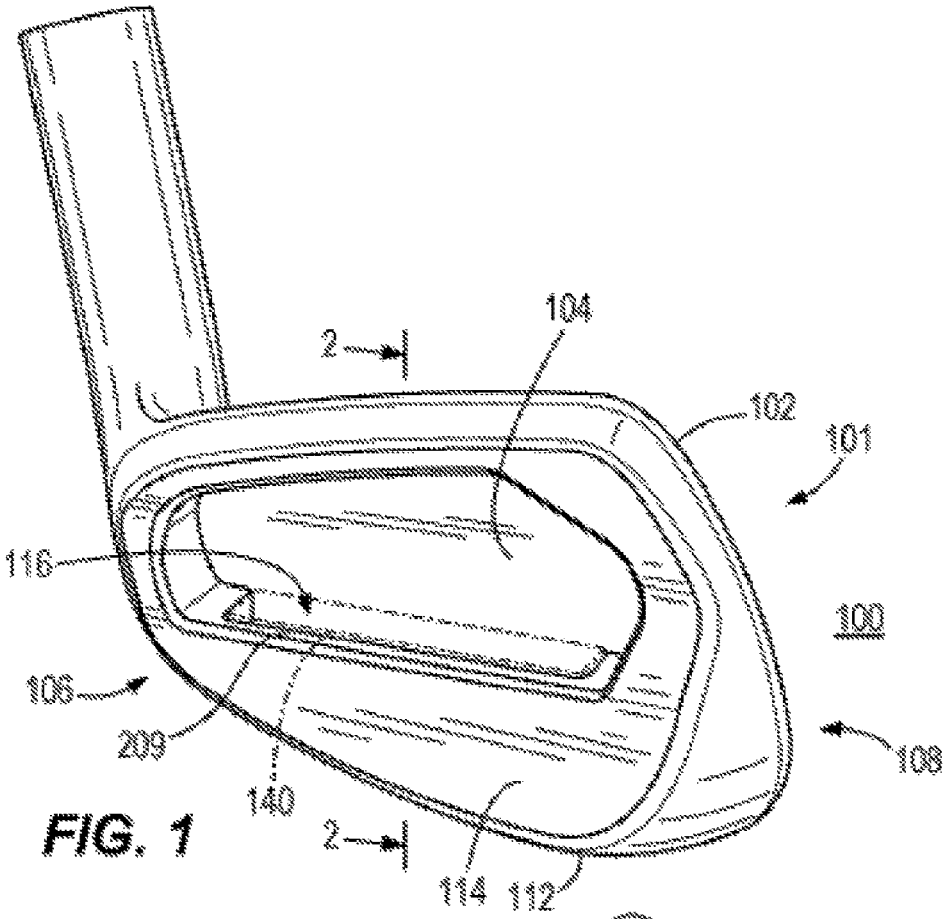
FIG. 1 depicts a back, toe-side perspective view of a golf club head according to an embodiment.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf club heads with cavities and related methods. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf club heads with cavities and related methods herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs and methods of manufacture described herein are, for example, capable of operation in other orientations than those illustrated or otherwise described herein.

"Mechanical coupling" and the like should be broadly understood and include mechanical coupling of all types.

The absence of the word "removably," "removable," and the like near the word "coupled," and the like does not mean that the coupling, etc. in question is or is not removable.

DESCRIPTION OF EXAMPLES OF EMBODIMENTS

Described herein is a golf club head that can comprise a central tuning port weight or insert (CTP) mechanically secured within a cavity of the golf club head. In many embodiments, the insert can comprise a first component and a second component, wherein the combination of the first and second component create a surface friction, or a retention lock/retention press fit to secure the insert within the cavity of the golf club head. In other embodiments, the insert comprises one component, which creates a press fit or mechanical interlock between the insert and a protrusion or other structure within the cavity of the golf club head. In some embodiments, the cavity of the golf club head can comprise one or more protrusions to receive one or more grooves of the insert. In these embodiments, the insert can be secured within the cavity by the mechanical interlock between the one or more protrusions, and one or more grooves, or alternatively a combination of an adhesive and the mechanical interlock between the one or more protrusions, and one or more grooves. The insert can comprise a softer material with a lower hardness compared to most inserts positioned within the cavity of the golf club head to maximize strikeface deflection. The insert with the softer material provides less support behind the strikeface during golf ball impacts. The hardness of the insert can range from Shore A 10 to Shore A 55. The contact area of the insert with the backface increases due to the softer insert material to provide more support behind the strikeface during golf ball impacts. The increase in contact area between the insert and backface can allow for a thinner strikeface. The lower hardness of the insert, the thinner strikeface, and the increase in contact area between the insert and the backface of the golf club head, maximizes the strikeface deflection during golf ball impacts.

According to one embodiment, a golf club head having a body comprises a strikeface, a backface opposite the strikeface, a heel region, a toe region opposite the heel region, a sole and a rear portion. The golf club head further comprises a cavity positioned between the rear portion and the backface. The cavity comprises a width, a rear side wall having a recess, a face side wall opposite the rear side wall, and a bottom wall. The cavity is configured to receive an insert (or CTP weight). The insert comprises a first component (or body) having a width slightly less than the width of the cavity, and a second component (or retainer) having a width greater than the width of the cavity. The first component of the insert comprises a front surface, and a back surface. The front surface of the body comprises a slot extending toward the back surface of the first component, wherein a portion of the slot is separated into one or more slots by portions of a material of the first component on the back surface of the body. The retainer of the insert is configured to be received by the first component through the one or more slots on the front surface. The retainer comprises a first edge having one or more tabs, and a second edge opposite the first edge having one or more arms, wherein the one or more arms can extend through the one or more slots. When the insert is positioned within the cavity, the one or more arms of the retainer are received within the recess on the rear side wall of the cavity and the one or more tabs of the retainer are pressed against the face side wall of the cavity. The retainer of the insert create a press fit to secure the insert within the cavity. The retainer further forms a U-shaped curve creating a retention lock against the walls of the cavity to further secure the insert.

According to another embodiment of the golf club head, the cavity comprises a face side wall, a rear side wall opposite the face side wall, and a bottom side wall. The bottom side wall comprises a post extending into a portion of the cavity. The cavity is configured to receive an insert having a first component (or body), and a second component (or retainer). The first component can comprise a front surface, a back surface, a top surface and a bottom surface, wherein the front surface is adjacent to the face side wall when the insert is positioned within the cavity. The first component can comprise an insert cavity positioned on the front surface to receive the retainer, and the bottom surface to receive the post. The retainer is washer-like in shape and comprises a top portion, a bottom portion, a bore, and tabs extending from the bore, planar to the top and bottom portion. The bore of the retainer is configured to receive the post when positioned within the insert cavity of the first component. When the insert is positioned within the cavity, the post is received through the bore of the retainer and extends into a portion of the insert cavity of the first component. Further, the tabs of the retainer extend in an upward curve toward the top surface of the first component, such that an upward force is created from the tabs against the post. The upward force prevents the insert from dislodging from the cavity during impact.

According to another embodiment of the golf club head, the cavity of the golf club head comprises a divider, separating the cavity into a first pocket and a second pocket. The divider comprises an aperture. The cavity is configured to receive an insert having a first component and a second component, wherein the first component is positioned in the first pocket, and the second component is positioned in the second pocket of the cavity. The insert further comprises an insert aperture extending the first and second component, and is concentric with the aperture of the divider of the cavity. The aperture of the divider and the insert aperture is configured to receive a fastener to compress the first component and second component of the insert together with the divider. The compression creates a surface friction between the first and second component with the divider, thereby securing the insert within the cavity of the golf club head.

According to another embodiment of the golf club head, the cavity of the golf club head is configured to receive an insert. The insert comprises a back surface, a front surface opposite the back surface, a heel region, a toe region opposite the heel region, a top surface, and a bottom surface opposite the top surface. The insert comprises a flex slot positioned centrally on the bottom surface of the insert. The flex slot allows for the insert to compress prior to being positioned within the cavity, such that the insert expands to its original form when positioned within the cavity. The expansion of the insert creates a press fit, which secures the insert within the cavity. The insert further comprises ribs positioned on the back surface to prevent the insert from shifting when an adhesive is applied into the cavity. The insert further still comprises a lip protruding from the top wall, perpendicular and adjacent the back surface if the insert. The insert further still comprises an undercut extending unto a portion of the insert, below and adjacent the lip of the insert to allow for more adhesive to be positioned between the cavity and the insert.

According to another embodiment of the golf club head, the golf club head comprises a face side wall, a rear side wall opposite the face side wall, and a bottom side wall forming the cavity. The rear side wall comprises one or more protrusions extending into a portion of the cavity. The cavity of the golf club head is configured to receive an insert. The insert comprises a back surface, a front surface opposite the back surface, a first end near a heel region of the golf club head, a second end near a toe region opposite the heel region of the golf club head, a top surface, and a bottom surface opposite the top surface. The insert comprises a groove positioned centrally on the back surface of the insert. The groove allows for the insert to be received by the one or more protrusions on the rear side wall of the golf club head. The insert further comprises one or more ribs positioned on the back surface, the first end, the second end, and the front surface to prevent the insert from shifting when an adhesive is applied into the cavity. The one or more ribs allow for the insert to compress when being positioned within the cavity. The expansion of the insert creates a press fit, which secures the insert within the cavity. The insert further comprises one or more recesses positioned on the front surface of the insert. The one or more recesses allow for a greater flow of an adhesive into the cavity and more adhesive to be positioned between the cavity and the insert. The insert further still comprises a lip protruding from the top wall, perpendicular and adjacent the back surface. The lip of the insert can act as a lever to remove the insert from the cavity during fittings and adjustments.

A. Locking Retainer Insert

1. Insert with Recess

Described herein is a golf club head 100 that can comprise a cavity 116. The cavity 116 can be configured to receive an insert 140. The cavity 116 can comprise a face side wall 120, a rear side wall 122 opposite the face side wall 120, and a bottom wall. The insert can comprise a first component 242 and a retainer 244. The retainer 244 is configured to be received within the first component 242, wherein the insert 140 is positioned within the cavity 116, and the retainer 244 comes in contact with the face side wall 120 and the rear side wall 122 of the cavity 116. The contact of the retainer 244 with the face side wall 120 and the rear side wall 122 during insertion results in the retainer 244 to bend and create a U-shape within the cavity 116. The bend of the retainer 244 into the U-shaped curve creates an upward force against the face side wall 120 and the rear side wall 122. The upward force prevents the insert 140 from dislodging out of the cavity 116 from an impact during a swing, and thus securing the insert 140 within the cavity 116.

Turning to the drawings, FIG. 1 illustrates a back, toe-side perspective view of a golf club head 100 according to an embodiment. Golf club head 100 is merely exemplary and is not limited to the embodiments presented herein. Golf club head 100 can be employed in many different embodiments or examples not specifically depicted or described herein.

In some embodiments, golf club head 100 can be an iron-type golf club head. In other embodiments, golf club head 100 can be another type of golf club head (e.g., a driver-type club head, a fairway wood-type club head, a hybrid-type club head, a wood-type club head, a wedge-type club head, or a putter-type club head). In some embodiments, golf club head 100 can comprise a strikeface 102, a backface 104 opposite strikeface 102, a heel region 106, a toe region 108 opposite heel region 106, a sole 112, and a rear portion 114. Golf club head 100 can further comprise a cavity 116 located between backface 104 and rear portion 114. In some embodiments, golf club head 100 can comprise a hosel, which in other embodiments can be omitted. In many embodiments, rear portion 114 can be designed to look similar to a traditional muscleback iron golf club head. For example, many muscleback irons have a full back or full rear portion of a golf club head. Muscleback irons differ from non-muscleback irons in which the rear or back of the golf club head has been hollowed out to at least partially remove the muscleback, full back and/or rear portion. In some embodiments, rear portion 114 can be designed to provide a heavy or thick look to the golf club head.

Figure 2:
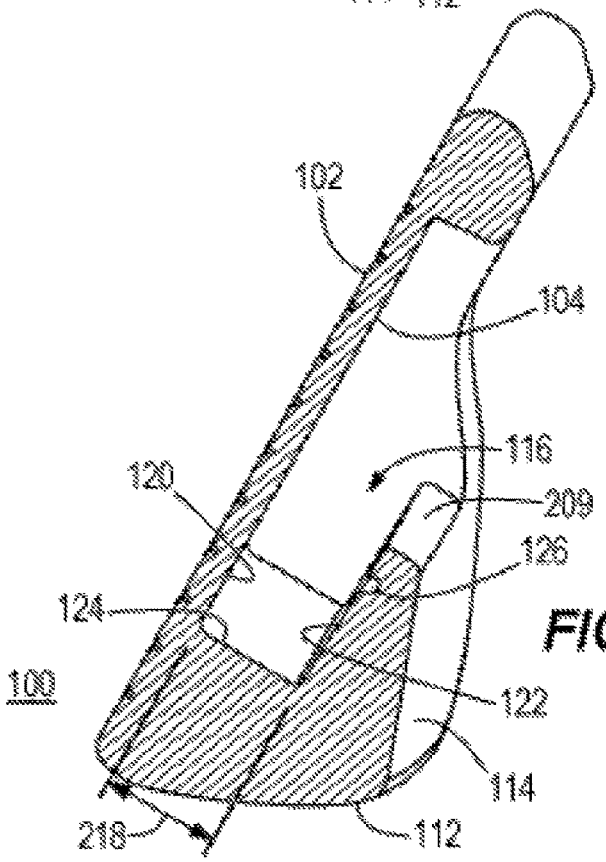
FIG. 2 depicts the golf club head of FIG. 1 along a cross-sectional line 2-2 in FIG. 1 without an insert in FIG. 1.

As illustrated in FIG. 2 (which is a view of the golf club head of FIG. 1 at cross-sectional line 2-2), the cavity 116 can comprise a face side wall 120 that can comprise a portion of the backface 104, a rear side wall 122 opposite the face side wall 120, and a bottom wall 124 positioned between the face side wall 120 and the rear side wall 122. The cavity 116 can further comprise a recess 126 positioned on a portion of the face side wall 120, the rear side wall 122, or both the face side wall 120 and the rear side wall 122. The recess 126 can extend from the heel region 106 to near the toe region 108 of the golf club head 100 to form a channel. In other embodiments as illustrated in FIG. 2, the rear side wall 122 can comprise recess 126. In other embodiments, both the face side wall 120 and the rear side wall 122 can comprise recesses 126.

The cavity 116 can further comprise a width 218. The width 218 of the cavity 116 is the distance measured from the face side wall 120 to the rear side wall 122. In some embodiments, the width 218 of the cavity 116 can range from 0.10 inch to 0.50 inch, 0.10 inch to 0.25 inch, 0.25 inch to 0.50 inch, 0.20 inch to 0.40 inch, 0.15 inch to 0.35 inch, or 0.30 inch to 0.45 inch. In other examples, width 218 can be at least 0.10 inch, at least 0.14 inch, at least 0.18 inch, at least 0.22 inch, at least 0.26 inch, at least 0.30 inch, a least 0.34 inch, at least 0.38 inch, at least 0.42 inch, at least 0.46 inch, or at least 0.50 inch.

Figure 3:
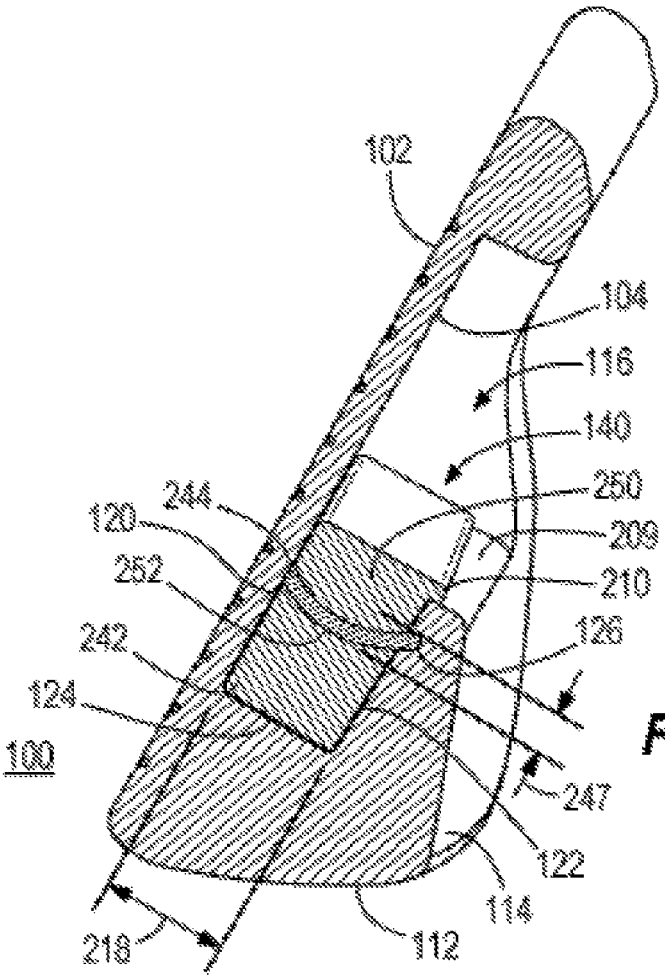
FIG. 3 depicts the golf club head of FIG. 1 along a cross-sectional line 2-2 in FIG. 1.

FIG. 3 illustrates the golf club head along a cross-sectional line 2-2 of FIG. 1. In some embodiments, the cavity 116 can be configured to receive an insert 140 at least partially within cavity 116. In other embodiments, the insert 140 complements the cavity 116 of the golf club head 100 wherein the insert 140 abuts the face side wall 120, the rear side wall 122, and the bottom wall 124 of the cavity 116. In many embodiments, insert 140 can dampen vibrations on golf club head 100 after impact of a golf ball on strikeface 102, which can improve in feel and reduce unwanted sound. Insert 140 can further lower the center of gravity of golf club head 100 for higher launch and increased inertia of golf club head 100. In some embodiments, insert 140 can comprise a dampening vibrational material, a filler insert, a weight member, and/or a custom tuning port (CTP) weight.

Figure 4A:
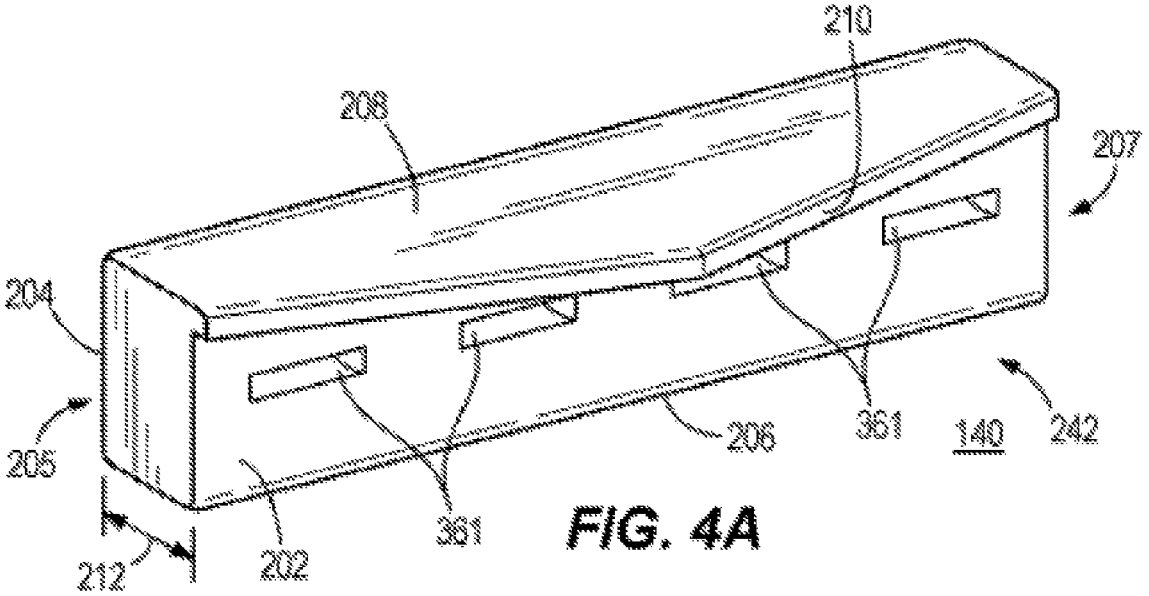
FIG. 4A depicts a back, heel-side perspective of a first component of the insert of the golf club head of FIG. 1.
Figure 4B:
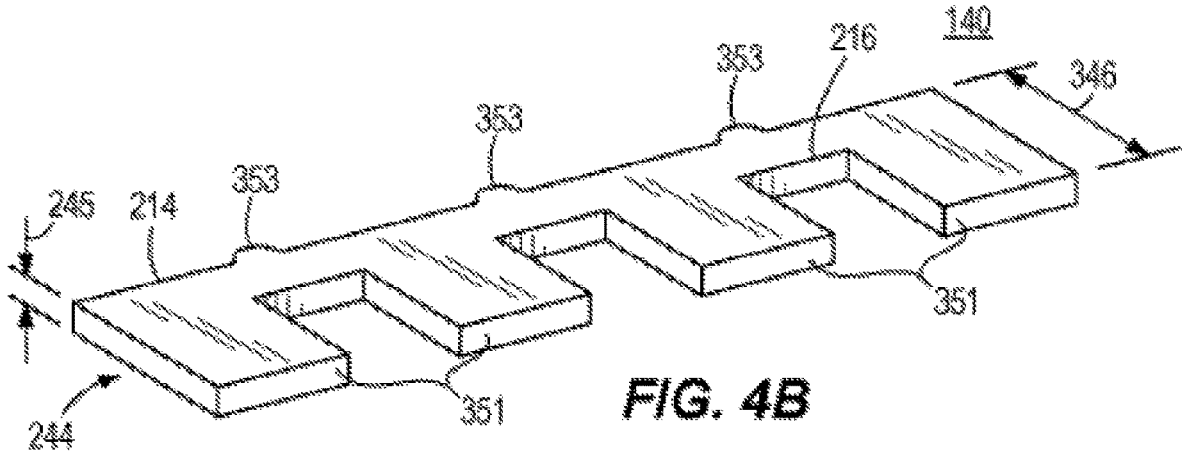
FIG. 4B depicts a back, heel-side perspective of a second component of the insert of the golf club head of FIG. 1.

As illustrated in FIGS. 4A and 4B, the insert 140 can comprise the first component or body 242 and the second component or retainer 244. The first component 242 can comprise a back surface 202, a front surface 204 opposite the back surface 202, a bottom surface 206, a top surface 208 opposite the bottom surface 206, a heel-region side 205, and a toe-region side 207 opposite the heel-region side 205. When the insert 140 is positioned within the cavity 116, the back surface 202 of the first component 242 is configured to be adjacent to the rear side wall 122 of the golf club head 100.

The first component 242 of the insert 140 further can comprise a width 212. The width 212 of the first component 242 is the distance measured from the back surface 202 to the front surface 204. In some examples, the width 212 of the first component 242 can be approximately equal to or slightly less than the width 218 of the cavity 116. In some embodiments, the width 218 of the first component 242 can range from 0.10 inch to 0.50 inch, 0.10 inch to 0.25 inch, 0.25 inch to 0.50 inch, 0.20 inch to 0.40 inch, 0.15 inch to 0.35 inch, or 0.30 inch to 0.45 inch. For example, the width 218 of the first component 242 can be 0.10 inch, 0.14 inch, 0.18 inch, 0.22 inch, 0.26 inch, 0.30 inch, 0.34 inch, 0.38 inch, 42 inch, 0.46 inch, or 0.50 inch.

As illustrated in FIG. 4A, the first component 242 can comprise one or more slots 361 positioned on the front surface 204, where the one or more slots 361 can extend all the way through the first component 242 toward the back surface 202. In some embodiments, the one or more slots 361 can extend partially into the front surface 204, leaving a portion of the first component 242 in between the one or more slots and the back surface 202. In this exemplary embodiment, the one or more slots 361 are positioned on the front surface 204 and the back surface 202. The one or more slots 361 can span from the heel-region side 205 to the toe-region side 207. In many embodiments, the one or more slots 361 can span parallel to the bottom surface 206, while in other embodiments, the one or more slots 361 can span diagonally relative to the bottom surface 206. In some embodiments, the one or more slots 361 can be void of any material of the first component 242. In some embodiments, the one or more slots 361 can comprise one, two, three, four, five, size, seven, or eight slots 361. When the first component 242 is positioned within the cavity 116, the one or more slots 361 of the back surface 202 are adjacent to the rear side wall 122 of the cavity 116 and the one or more slots 361 of the front surface 204 are adjacent to the face side wall 120.

The first component 242 of the insert 140 can further comprise a ledge 210. The ledge 210 extends from the top surface 208, adjacent and perpendicular to the back surface 202. The ledge 210 of the first component 242 can extend evenly from the heel-region side 205 to the toe-region side 207, creating a straight ledge. In other embodiments, the ledge 210 can extend varying lengths from the heel-region side 205 to the toe-region side 207 of the first component 242. For example, as illustrated in FIG. 3, the length of the ledge 210 increases, then decreases from the heel-region side 205 to the toe-region side 207 of the first component 242, wherein is the length of the ledge 210 is greatest at a midpoint of the first component 242. As illustrated in FIG. 3, when the insert 140 is positioned within the cavity 116, the ledge 210 of the top surface 208 abuts against a top surface 209 of the rear portion 114. The ledge 210 of the top surface 202 can act as a leverage ledge to allow manufacturers to remove the insert 140 from the cavity 116 during fittings or adjustments.

The first component 242 of the insert can further comprise a mass. The mass of the first component 242 can range from 0.02 gram to 32 grams, 0.02 gram to 0.40 gram, 0.040 gram to 0.80 gram, 0.080 gram to 3 grams, 3 grams to 9 grams, 9 grams to 15 grams, 15 grams to 21 grams, 21 grams to 27 grams, 27 grams to 32 grams, 0.02 gram to 10 grams, 10 grams to 20 grams, or 20 grams to 32 grams. For example, the mass of the first component 242 can be 0.02 grams, 0.50 grams, 1 gram, 5 grams, 10 grams, 15 grams, 20 grams, 25 grams, 30 grams, or 32 grams.

The retainer 244 of the insert 140 can be configured to be removably received within the one or more slots 361 positioned on the front surface 204 and the back surface 202 of the first component 242 without the use of threads. The retainer 244 of the insert 140 interlocks with the one or more slots 361 in the direction of the front surface 204 of the first component 242 to the back surface 202 of the first component 242. The retainer 244 can be configured to be received within the first component 242 of the insert 140 without the use of threading, welding, or brazing connection means. In some embodiments, the geometry of the retainer 244 and one or more slots 361 can allow the retainer 244 to interlock with the first component 242 of the insert 140 without the use of threads. In many embodiments, the retainer 244 can be received by and/or secured within the one or more slots 361 by press-fit, co-molding, friction-fit, an adhesive, or by any suitable means. The retainer 244 of the insert 140 can comprise a first edge 214, a second edge 216 opposite the first edge 214, a top surface 213, and a bottom surface 215 opposite the top surface 213. In some embodiments, the first edge 214 of the retainer 244 is a flat surface. In other embodiments, the first edge 214 can comprise one or more tabs 353 extending from the flat surface of the first edge 214. In many embodiments when the insert 140 is positioned within the cavity 116, the one or more tabs 353 of the retainer 244 are adjacent to and contact the face side wall 120. In other embodiments, the one or more tabs 353 can be received into a recess (not shown) on the face side wall 120 of the cavity 116 to help secure the insert 140 within the cavity 116.

The second edge 216 of the retainer 244 can comprise one or more arms 351 extending from the second edge 216. When the retainer 244 is positioned within the slot 361 of the body 242, the one or more arms 351 of the retainer 244 is configured to be received within the one or more slots 361. When the insert 140 is positioned within the cavity 116, the one or more arms 351 are adjacent to and contact the rear side wall 122 of the cavity 116. In some embodiments as illustrated in FIG. 3, the one or more arms 351 can be further received into the recess 126 on the rear side wall 122 of the cavity 116 to help secure the insert 140 within the cavity 116. In some embodiments, the one or more arms 351 can comprise one, two, three, four, five, six, seven, eight arms 351. In many embodiments, the number of arms 351 can correspond to the number of slots 361. In many embodiments as illustrated in FIGS. 4A and 4B, the retainer 244 can comprise the same number of arms 351 as the number of slots 361 of the first component 242.

The retainer 244 can further comprise a width 346. The width 346 of the retainer 244 is the distance measured from the first edge 214 (or tabs 353) to an edge of the arm 351. In some embodiments, the width 346 of the retainer 244 can range from 0.10 inch to 0.60 inch, 0.10 inch to 0.30 inch, 0.30 inch to 0.60 inch, 0.20 inch to 0.44 inch, 0.15 inch to 0.35 inch, or 0.35 inch to 0.55 inch. In other examples, width 346 can be 0.10 inch, 0.12 inch, 0.14 inch, 0.16 inch, 0.18 inch, 0.20 inch, 0.22 inch, 0.24 inch, 26 inch, 0.28 inch, 0.30 inch, 0.32 inch, 0.34 inch, 36 inch, 0.38 inch, 0.40 inch, 0.42 inch, 0.44 inch, 0.46 inch, 0.48 inch, 0.50 inch, 0.52 inch, 0.54 inch, 0.56 inch, 0.58 inch, or 0.60 inch. The width 346 of the second component 244 can be equal to, or greater than the width 212 of the first component 242.

The retainer 244 can further comprise a thickness 245 measured from the top surface 213 of the retainer 244 to the bottom surface 215 of the retainer. In some embodiments, the thickness 245 of the retainer 244 can range from 0.0002 inch (0.00508 mm) to 0.400 inch (10.16 mm). In other embodiments, the thickness 245 can range from 0.010 inch (0.254 mm) to 0.20 inch (5.08 mm). In some examples, the thickness 245 of the retainer 244 can be approximately 0.001 inch (0.0254 mm), 0.002 inch (0.0508 mm), 0.003 inch (0.0762 mm), 0.004 inch (0.1016 mm), 0.005 inch (0.127 mm), 0.006 inch (0.1524 mm), 0.007 inch (0.1778 mm), 0.008 inch (0.2032 mm), 0.009 inch (0.2286 mm), 0.01 inch (0.254 mm), 0.02 inch (0.508 mm), 0.03 inch (0.762 mm), 0.04 inch (1.016 mm), 0.05 inch (1.27 mm), 0.06 inch (1.524 mm), 0.07 inch (1.778 mm), 0.08 inch (2.032 mm), 0.09 inch (2.286 mm), 0.1 inch (2.54 mm), 0.2 inch (5.08 mm), 0.3 inch (7.62 mm), 0.35 inch (8.89 mm), or 0.40 inch (10.16 mm).

The retainer 244 can further comprise a mass. The mass of the retainer 244 can range from 0.02 gram to 0.15 gram, 0.02 gram to 0.07 gram, 0.07 gram to 0.15 gram, 0.02 gram to 0.06 gram, 0.04 gram to 0.08 gram, 0.06 gram to 0.10 gram, 0.07 gram to 0.12 gram, or 0.08 gram to 0.015 gram. For example, the mass of the retainer 244 can be 0.02 gram, 0.04 gram, 0.06 gram, 0.08 gram, 0.10 gram, 0.12 gram, 0.14 gram, or 0.15 gram.

In many embodiments, the insert, comprising the combination of the first component 242 and the retainer 244 can comprise a mass. The mass of the insert 140 can range from 0.5 gram to 36 grams, 0.5 gram to 4 grams, 4 grams to 8 grams, 8 grams to 12 grams, 12 grams to 16 grams, 16 grams to 20 grams, 20 grams to 24 grams, 24 grams to 28 grams, 28 grams to 32 grams, 32 grams to 36 grams, 4 grams to 16 grams, 16 grams to 24 grams, or 24 grams to 32 grams. For example, the mass of the insert 140 can be 0.02 grams, 0.50 grams, 1 gram, 5 grams, 10 grams, 15 grams, 20 grams, 25 grams, 30 grams, or 36 grams.

To mate the first component 242 and the retainer 244 together to form the insert 140, the retainer 244 can be positioned within the one or more slots 361 of the first component 242 through the front surface 204 of the first component 242, wherein the one or more arms 351 is received within the one or more slots 361. In some embodiments, an end of the one or more arms 351 can be flush with the back surface 202 of the first component 242. In other embodiments as illustrate in FIG. 3, the width 346 of the retainer 244 is greater than the width 212 of the first component 242, such that the one or more arms 351 extends past the back surface 202 of the first component 242. In this embodiment, the one or more arms 351 can be received within the recess 126 of the rear side wall 122 of the cavity 116 when the insert 140 is positioned within the cavity 116 to help secure the insert 140 within the cavity 116.

In many embodiments, the one or more arms 351 can evenly distribute a stiffness of the second component 244 across a length of the second component 244. In some embodiments, the one or more arm 351 can evenly distribute a weight of the second component 244 across the length of the second component 244. In many embodiments, a minimum width 357 of each of the one or more arm 351 can be approximately the same as the thickness 245 of the second component 244. In other embodiments, the minimum width 357 of the one or more arms 351 can be approximately twice or three times the thickness 245 of the second component 244.

In some embodiments, when the insert 140 is positioned within the cavity 116, the second component 244 can be in contact with at least a portion of the cavity 116 of the golf club head 100. In some embodiments, the second component 244 can be in contact with at least two portions of the cavity 116 of the golf club head 100. In some embodiments, the one or more tabs 353 can be in contact with the face side wall 120 of the cavity 116, and the one or more arms 351 can be in contact with the rear side wall 122. In many embodiments, when the retainer 244 is in contact with the portion of the cavity 116 of the golf club head 100, the contact point(s) can provide further tension and/or friction to secure the insert 140 within the cavity 116. In some embodiments, an adhesive can be used to assist with securing the insert 140 within the cavity 116. In some embodiments, no adhesive is used to secure or assist in securing the insert 140 within the cavity 116.

In some embodiments, when the insert 140 is positioned within the cavity 116, the one or more arms 351 of the retainer 244 are received within the recess 126 of the rear side wall 122 of the cavity 116, and the one or more tabs 353 press against or abut the face side wall 120 of the cavity 116. Accordingly, the retainer 244 bends the retainer into a U-shape curve, as illustrate in FIG. 3. In other embodiments, the cavity 116 can be void of the recess 126, and the width 346 of the retainer 244 can be greater than the width 218 of cavity 116. In this embodiment, when the insert 140 is positioned within the cavity 116, the one or more tabs 353 press against or abut the face side wall 120 and the one or more arms 351 press against or abut the rear side wall 122, such that the retainer 244 bends into a U-shape curve. In these embodiments, the U-shape curve of the retainer 244 creates an upward force against the face and rear side wall 120 and 122 to prevent dislodging of the insert 140 out of the cavity 116 during impact.

As illustrated in FIG. 3, in embodiments wherein the width 346 of the retainer 244 is greater than the width 218 of the cavity 116, the retainer 244 forms an arcuate shape (U-shape curve) when positioned within the cavity 116. The sagitta distance 247 is the height of an arcuate shape. When the insert 140 is positioned within the cavity, the height of the arcuate shape is measured perpendicular from the first edge 214 of the retainer 244 to a midpoint of the arch 252 of the retainer 244.

In some embodiments, the sagitta distance 247 of the second component 224 can be approximately 5 percent (%) to approximately 25% of the width 218 of the cavity 116. In some embodiments, sagitta distance 247 can be approximately 5%, 6%, 7%, 8%, 9%, 10%, 11%, 12%, 13%, 14%, 15%, 16%, 17%, 18%, 19%, 20%, 21%, 22%, 23%, 24%, or 25% of the width 218 of the cavity 116. According to one example, when the width 218 of the cavity 116 is approximately 0.20 inch (5.08 mm), sagitta distance 247 can range from 0.01 inch (0.254 mm) to approximately 0.05 inch (1.27 mm). For example, the sagitta distance 247 can be 0.01 inch (0.254 mm), 0.015 inch (0.381 mm), 0.02 inch (0.508 mm), 0.025 inch (0.635 mm), 0.030 inch (0.762 mm), 0.035 inch (0.889 mm), 0.040 inch (1.016 mm), 0.045 inch (1.143 mm), or 0.05 inch (1.27 mm).

In many embodiments, the retainer 244 of insert 140 can comprise a plastically deformable material. In some embodiments, the plastically deformable material of the retainer 244 can comprise metal, shim stock, steel, aluminum, copper, other suitable metals, metal alloy, plastic, or composite material. In other embodiments, the retainer 244 can comprise an elastically deformable material or a shape memory metal or metal alloy, such as nickel titanium. In some embodiments, a hardness of the retainer 244 can range from Shore A 55 to Shore A 70.

In many embodiments, the first component 242 of insert 140 can comprise elastically deformable material. For example, the elastically deformable material of the first component 242 can comprise a polymer, a urethane material, a urethane-based material, an elastomer material, a thermoplastic material, a composite, other suitable types of material, or a combination thereof. In some embodiments, the elastically deformable material of the first component 242 of insert 140 can further comprise a thermoplastic elastomer or a thermoplastic polyurethane mixed with powdered metals. In many embodiments, the powdered metals can be used to vary the weighting properties of insert 140.

In some embodiments, the material of the first component 242 and the material of the retainer 244 can be different from one another. In other embodiments, the material of the first component 242 and the material of the retainer 244 can comprise the same material. In some embodiments, the material of the first component 242 and the material of the retainer 244 can each be denser than a material of the golf club head 100. In other embodiments, the material of the first component 242 and the material of the retainer 244 can be the same density or less dense than the material density of golf club head 100.

2. Insert with Post

Described herein is a golf club head 400 that can comprise a cavity 416. As described below, the cavity 416 can be configured to receive an insert 440. The cavity 416 can comprise a face side wall 420, a rear side wall 422 opposite the face side wall 420, a bottom wall 424, and a post 519 extending from the bottom wall 424. The insert 440 can comprise a first component 542, and a retainer 544. The first component 542 is configured to receive the retainer 544. The retainer 544 is washer-like in shape, and can comprise a bore 568 and tabs 658 extending planar from the bore 568. When the insert 440 is positioned within the cavity 416, the post 519 of the cavity 416 is configured to be received within the bore 568, pushing up the tabs 648 of the retainer 544. The upward orientation of the tabs 648 create an upward force against the post 519. The upward force on the post 519 by the tabs 648 secures the insert 440 within the cavity 416. The abutment of the surfaces of the insert 440 against the walls of the cavity 416 creates a press fit, which further prevents the insert 440 from dislodging during an impact.

Figure 5:
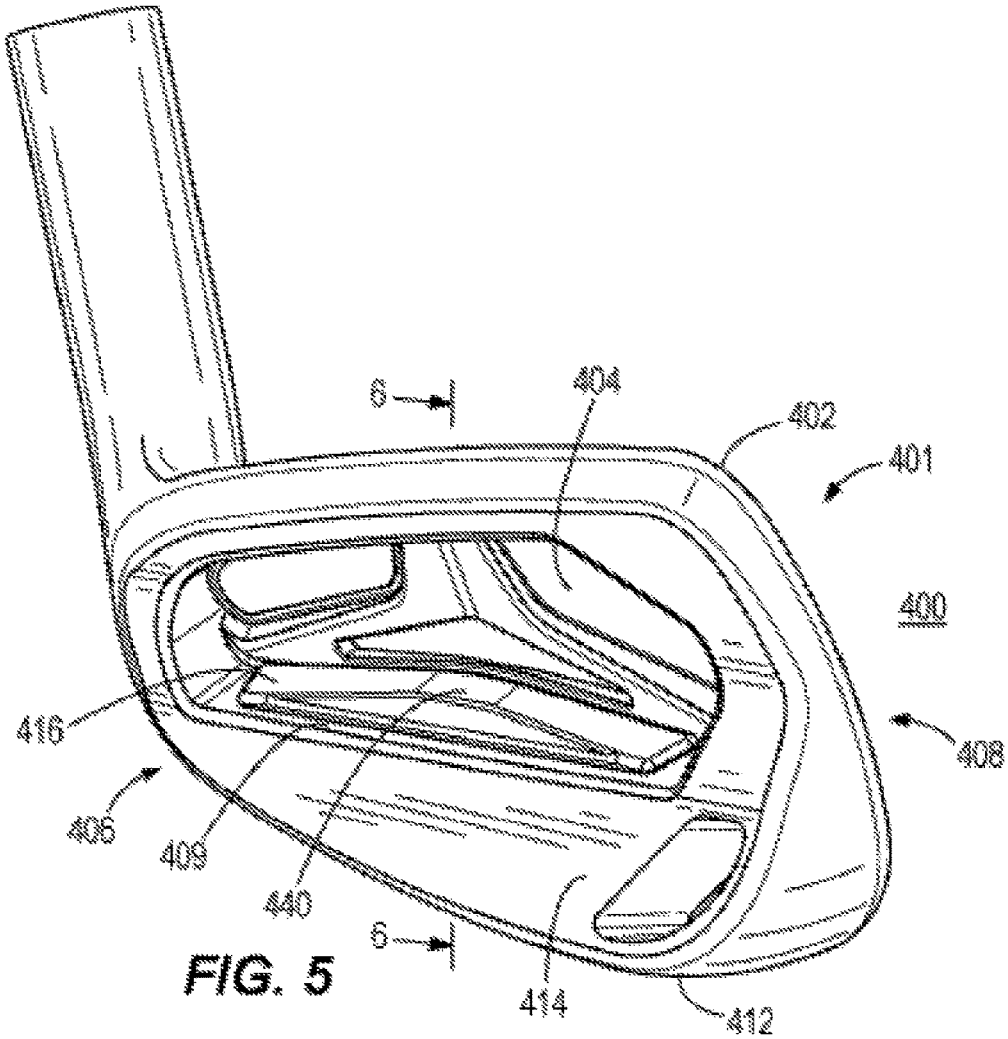
FIG. 5 depicts a back, toe-side perspective view of a golf club head according to another embodiment.

FIG. 5 illustrates a golf club head 400, which can be similar to golf club head 100 of FIG. 1. In some embodiments, golf club head 400 can be an iron-type golf club head. In other embodiments, golf club head 400 can be another type of golf club head (e.g., a driver-type club head, a fairway wood-type club head, a hybrid-type club head, a wood-type club head, a wedge-type club head, or a putter-type club head). In some embodiments, golf club head 400 can comprise a strikeface 402, a backface 404 opposite strikeface 402, a heel region 406, a toe region 408 opposite heel region 406, a sole 412, and a rear portion 414. Golf club head 400 can further comprise a cavity 416 located between backface 404 and rear portion 414. In some embodiments, golf club head 400 can comprise a hosel, which in other embodiments can be omitted. In many embodiments, rear portion 414 can be designed to look similar to a traditional muscleback iron golf club head. For example, many muscleback irons have a full back or full rear portion of a golf club head. Muscleback irons differ from non-muscleback irons in which the rear or back of the golf club head has been hollowed out to at least partially remove the muscleback, full back and/or rear portion. In some embodiments, rear portion 414 can be designed to provide a heavy or thick look to the golf club head.

Figure 6:
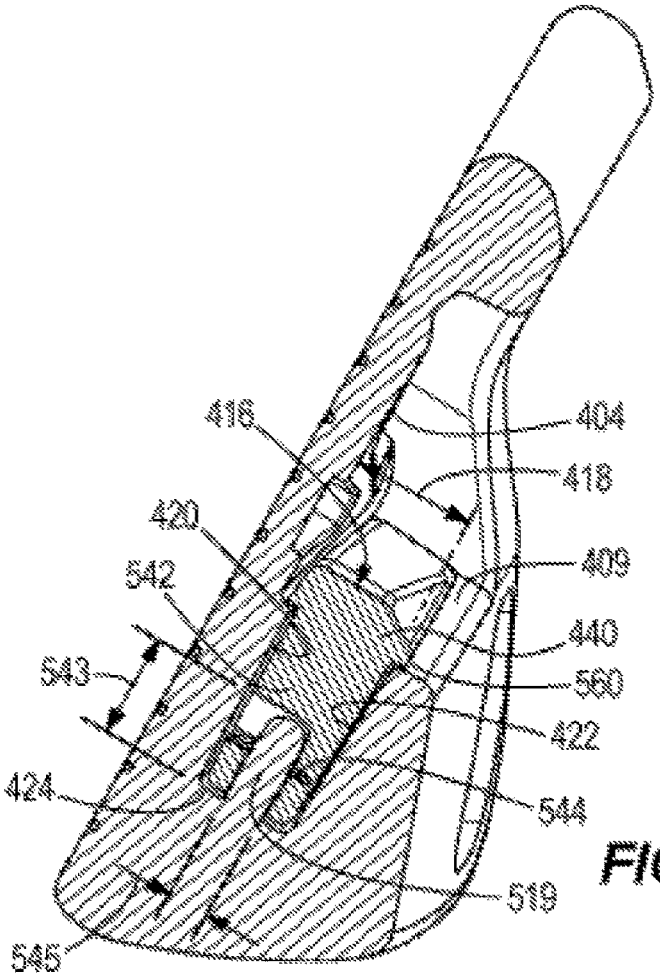
FIG. 6 depicts the golf club head of FIG. 4 along a cross-sectional line 5-5 in FIG. 5.

Illustrated in FIG. 6 is a view of the golf club head in FIG. 5 from the cross-sectional line 5-5. The cavity 416 can comprise a face side wall 420 that can comprise a portion of the backface 404, a rear side wall 422 opposite the face side wall 420, and a bottom wall 424 positioned between the face side wall 420 and the rear side wall 422.

The cavity 416 of the golf club head 400 can further comprise a width 418. The width 418 of the cavity 416 is the distance measured from the face side wall 420 to the rear side wall 422. In some embodiments, the width 418 of the cavity 416 can from 0.10 inch to 0.50 inch, 0.10 inch to 0.25 inch, 0.25 inch to 0.50 inch, 0.20 inch to 0.40 inch, 0.15 inch to 0.35 inch, or 0.30 inch to 0.45 inch. For example, the width 418 of the cavity 416 can be 0.10 inch, 0.14 inch, 0.18 inch, 0.22 inch, 0.26 inch, 0.30 inch, 0.34 inch, 0.38 inch, 42 inch, 0.46 inch, or 0.50 inch.

The cavity 416 of the golf club head 400 can further comprise a post 519 extending from the bottom wall 424, but can be any shape (e.g., cylinder, square, rectangle, rhombus, etc.). The post 519 can also be referred to as a rod. In some embodiments, the post 519 extends from a center of the bottom wall 424 in between the face side wall 420 and the rear side wall 424, as well as in between the heel region 406 and the toe region 408. In other embodiments, the post 519 can extend anywhere from the bottom wall 424. For example, the post 519 can extend from the bottom wall 424 near the toe region 408, near the heel region 406, near the face side wall 420, near the rear side wall 422, or any other location on the bottom wall 424. In some embodiments, the cavity 416 can comprise more than one post 519. In some embodiments, the cavity 416 can comprise one, two, three, four, five, six, seven, or eight posts 519.

In other embodiments, where there is a void in the rear portion 414, the post 519 can extend from the face side wall 420 of the cavity 416. In some embodiments, the post 519 extending from the face side wall 420 can be positioned centrally, near the heel region 406, or near the toe region 408. In some embodiments, the cavity 416 can comprise more than one post 519. In some embodiments, the cavity 416 can comprise one, two, three, four, five, six, seven, or eight posts 519. For one example, one post 519 can extend from the face side wall 420 near the heel region 406, and a second post can extend from the face side wall 430 near the toe region 408.

The post 519 can comprise a post height 543. The post height 543 is measured as the distance the post 519 extends into the cavity 416 from the bottom wall 424. In some embodiments, the post height 543 can range from 0.12 inch to 0.40 inch, 0.12 inch to 0.15 inch, 0.15 inch to 0.20 inch, 0.20 inch to 0.25 inch, 0.25 inch to 0.30 inch, 0.030 inch to 0.35 inch, 0.35 inch to 0.40 inch, 0.15 inch to 0.25 inch, or 0.30 inch to 40 inch. For example, the post height 543 can be 0.12 inch, 0.13 inch, 0.14 inch, 0.15 inch, 0.16 inch, 0.17 inch, 0.18 inch, 0.19 inch, 0.20 inch, 0.21 inch, 0.22 inch, 0.23 inch, 0.24 inch, 0.25 inch, 0.26 inch, 0.27 inch, 0.28 inch, 0.29 inch, 0.30 inch, 0.31 inch, 0.32 inch, 0.33 inch, 0.34 inch, 0.35 inch, 0.36 inch, 0.37 inch, 0.38 inch, 0.39 inch, or 0.40 inch.

The post 519 can further comprise a diameter 545. The diameter 545 of the post 519 can range from 0.050 inch to 0.115 inch, 0.050 inch to 0.065 inch, 0.065 inch to 0.80 inch, 0.080 inch to 0.095 inch, 0.095 inch to 0.110 inch, 0.105 inch to 0.115 inch, 0.065 inch to 0.095 inch, or 0.095 inch to 0.115 inch. For example, the diameter 545 of the post 519 can be 0.050 inch, 0.060 inch, 0.070 inch, 0.080 inch, 0.090 inch, 0.10 inch, or 0.115 inch.

In many embodiments, cavity 416 can be configured to receive an insert 440. In many embodiments, the insert 440 can be similar to the insert 140 (FIGS. 1, 3, 4A and 4B). The insert 440 can comprise the first component or body 542, and the second component or retainer 544.

Figure 7A:
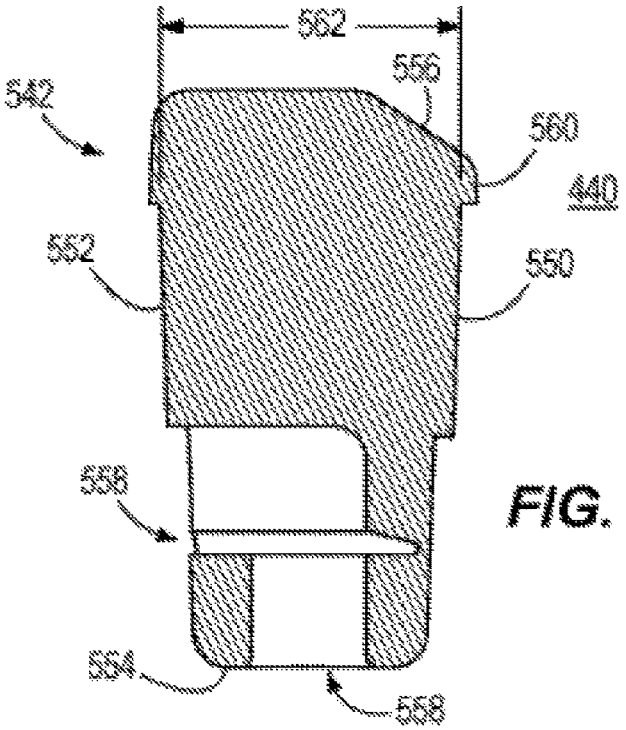
FIG. 7A depicts a first component of an insert of the golf club head of FIG. 5.

As illustrated in FIG. 7A, the first component 542 can comprise a back surface 550, a front surface 552 opposite the back surface 550, a bottom surface 554, a top surface 556 opposite the bottom surface 554, a heel-region side, and a toe-region side opposite the heel-region side. When the insert 440 is positioned within the cavity 416, the back surface 550 of the first component 542 is configured to be adjacent the rear side wall 422 of the cavity 416.

The first component 542 of the insert 440 can further comprise a width 562. The width 562 is the distance measured from the back surface 550 to the front surface 552. In some examples, the width 562 of the first component 542 can be approximately equal to or slightly less than the width 418 of the cavity 416. In other embodiments, the width 562 of the first component 542 can range from 0.10 inch to 0.50 inch, 0.10 inch to 0.25 inch, 0.25 inch to 0.50 inch, 0.20 inch to 0.40 inch, 0.15 inch to 0.35 inch, or 0.30 inch to 0.45 inch. In other examples, width 562 of the first component 542 can be at least 0.10 inch, at least 0.14 inch, at least 0.18 inch, at least 0.22 inch, at least 0.26 inch, at least 0.30 inch, a least 0.34 inch, at least 0.38 inch, at least 0.42 inch, at least 0.46 inch, or at least 0.50 inch. According to one embodiment, the width 562 of the first component 542 is 0.2 inch.

In some embodiments, the front surface 552 of the first component 542 can comprise an insert cavity 558 extending into a portion of the first component 542 configured to receive the retainer 544 of the insert. In other embodiments, the bottom surface 554 of the first component 542 can comprise the insert cavity 558 configured to receive the post 519 of the cavity 416. In other embodiments, the first component 542 can comprise the insert cavity 558 on the front surface 552 and the bottom surface 554 of the first component 542 configured to receive both the retainer 544 and the post 519. In some embodiments, the insert cavity 558 can comprise a cross-sectional shape complementary to a cross-sectional shape of the post 519 of the cavity 416. In other embodiments, the cross-sectional shape of the insert cavity 558 can comprise a complementary cross-sectional shape of the post 519 and the retainer 544 together, wherein the insert cavity 558 can be configured to receive both the post 519 and the retainer 544. In other embodiments, the cross-sectional shape of the post cavity 558 can be different from the cross-sectional shape of the post 519 and the second component 544 together. In other embodiments, the front surface 552 and bottom surface 554 of the first component 542 can comprise one, two, three, or four insert cavities 558.

The first component 542 of the insert 440 further can comprise a ledge 560. The ledge 560 of the first component 542 extends from the top surface 556, adjacent and perpendicular to the back surface 550. The ledge 560 of the first component 542 can extend evenly from the heel-region side to the to-region side of the first component 542, creating a straight ledge. In other embodiments, the ledge 560 can extend varying lengths from the heel-region side to the toe-region side of the first component 542. When the insert 440 is positioned within the cavity 416, the ledge 5610 of the top surface 556 abuts against a top surface 409 of the rear portion 414. The ledge 560 of the top surface 556 can act as a leverage ledge to allow manufacturers to remove the insert 440 from the cavity 416 during fittings or adjustments.

The first component 542 of the insert can further comprise a mass. The mass of the first component 542 can range from 0.02 gram to 32 grams, 0.02 gram to 0.40 gram, 0.040 gram to 0.80 gram, 0.080 gram to 3 grams, 3 grams to 9 grams, 9 grams to 15 grams, 15 grams to 21 grams, 21 grams to 27 grams, 27 grams to 32 grams, 0.02 gram to 10 grams, 10 grams to 20 grams, or 20 grams to 32 grams. For example, the mass of the first component 542 can be 0.02 grams, 0.50 grams, 1 gram, 5 grams, 10 grams, 15 grams, 20 grams, 25 grams, 30 grams, or 32 grams.

Figure 7B:
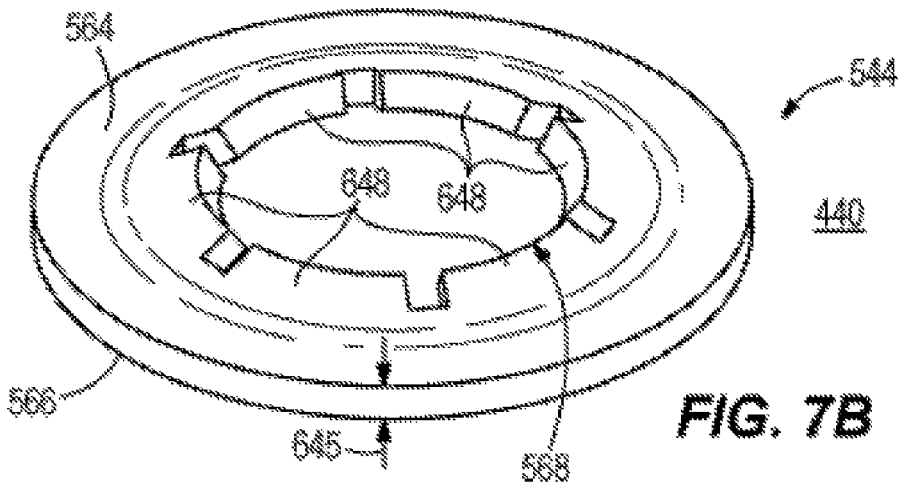
FIG. 7B depicts a second component of the insert of the golf club head of FIG. 5.

The retainer 544 of the insert 440 is configured to be received by the first component 542. The retainer 544 can be received within the first component 542 by the insert cavity 558 positioned on the front surface 552 of the first component 542. As illustrated in FIG. 7B, the retainer 544 can comprise a washer-like shape and includes a top surface 564, a bottom surface 566, and a bore 568.

When the insert 440 is positioned within the cavity 416, the bore 568 of the retainer 544 is configured to receive the post 519 of the cavity. The bore 568 can comprise a tab 648. The tab 648 can be one, two, three, four, five, six, seven, or eight tabs 648. In these embodiments, the bore can further comprise cavities disposed between each tab 648. In some embodiments, the tabs 648 can be positioned equidistantly from one another. In other embodiments, the tabs 648 can be spaced apart at any distance from one another. In many embodiments, the tab 648 can be orientated flush or planar with the top and bottom surfaces 564, and 566. In other embodiments, when the retainer 544 is positioned within the first component 542, and the insert 440 is positioned within the cavity 416, the cavities of the retainer 544 allow the tabs 648 to bend upward toward the top surface 556 of the first component 542 when the bore 568 receives the post 519. The upward bend of the tabs 648 create an upward force and friction against the post 519, forcing the retainer 544, and thus the insert 440, downward within the cavity 416. The upward force and friction act like a hook on the post 519 preventing dislodging of the insert 440 during impact.

The retainer 544 can further comprise a thickness 645. The thickness 645 of the retainer 544 is the distance measured from the top surface 564 to the bottom surface 566 of the retainer 544. In some embodiments, the thickness 645 can range from 0.0002 inch to 0.400 inch. In other embodiments, the thickness 645 can range from 0.010 inch to 0.20 inch, 0.0002 inch to 0.010 inch, 0.010 inch to 0.080 inch, 0.050 inch to 0.150 inch, 0.120 inch to 0.250 inch, 0.200 inch to 0.350 inch, or 0.300 inch to 0.400 inch. For example, the thickness 645 can be 0.001 inch, 0.002 inch, 0.003 inch, 0.004 inch, 0.005 inch, 0.006 inch, 0.007 inch, 0.008 inch, 0.009 inch, 0.01 inch, 0.02 inch, 0.03 inch, 0.04 inch, 0.05 inch, 0.06 inch, 0.07 inch, 0.08 inch, 0.09 inch, 0.1 inch, 0.2 inch, 0.3 inch, 0.35 inch, or 0.4 inch.

The retainer 544 can further comprise a mass. The mass of the retainer 544 can range from 0.02 gram to 0.15 gram, 0.02 gram to 0.07 gram, 0.07 gram to 0.15 gram, 0.02 gram to 0.06 gram, 0.04 gram to 0.08 gram, 0.06 gram to 0.10 gram, 0.07 gram to 0.12 gram, or 0.08 gram to 0.015 gram. For example, the mass of the retainer 544 can be 0.02 gram, 0.04 gram, 0.06 gram, 0.08 gram, 0.10 gram, 0.12 gram, 0.14 gram, or 0.15 gram.

To form the insert 440, the retainer 544 is positioned within the insert cavity 558 on the front surface 552 of the first component 542. The insert 440 can be positioned within the cavity 416 of the golf club head 400, such that the insert cavity 558 is positioned on the bottom surface 554 of the first component 542 receives the post 519 of the cavity 416. The post 519 extends through the insert cavity 558 of the first component 542 and through the bore 568 of the retainer 544. The front surface 552 of the first component 542 abuts the face side wall 420 of the cavity 416, and the back surface 550 of the first component 542 abuts against the rear side wall 422 of the cavity 416, wherein the abutment create a press fit, further securing the insert 440 from dislodging during impact. In some embodiments, an adhesive can be used to assist in securing insert 440 in cavity 416. In other embodiments, no adhesive is used to secure or assist in securing insert 440 in cavity 416.

In a number of embodiments, the retainer 544 can be contact with at least a portion of the cavity 416 of the golf club head 400. In many embodiments, the retainer 544 is not in contact with the face side wall 420 of the cavity 416. Rather, the retainer 544 can be in contact with post 519.

In other embodiments, the insert 440 can comprise a first component 542, a retainer 544, and a third component, wherein the third component can be similar to the retainer 544. In these and other embodiments, the third component can comprise a washer-like shape, similar to the retainer 544. In many embodiments, at least a portion of the post 519 can be in contact with the third component, and the retainer 544 within the insert cavity 558. In some embodiments, the retainer 544 can be the same size as the third component. In other embodiments, the retainer 544 can be greater in size than the third component, or less in size than the third component. In other embodiments, the retainer 544 and the third component can comprise a different shape from one another.

In other embodiments, the first component 542 of the first insert can comprise more than one insert cavity 558, to be positioned within the cavity 416 comprising more than one post 519. In many embodiments, the number and position of the insert cavities 558 can correspond with the number posts 519 of the cavity 416. In other embodiments, the number of posts 519 of the cavity 416 can be less than the number of insert cavities 558 of the first component 542.

In many embodiments, the combination of the first component 542 and the retainer 544 combined forming the insert 440 can comprise a mass. The mass of the insert 440 can range from 0.5 gram to 36 grams, 0.5 gram to 4 grams, 4 grams to 8 grams, 8 grams to 12 grams, 12 grams to 16 grams, 16 grams to 20 grams, 20 grams to 24 grams, 24 grams to 28 grams, 28 grams to 32 grams, 32 grams to 36 grams, 4 grams to 16 grams, 16 grams to 24 grams, or 24 grams to 36 grams. For example, the mass of the insert 440 can be 0.02 grams, 0.50 grams, 1 gram, 5 grams, 10 grams, 15 grams, 20 grams, 25 grams, 30 grams, or 36 grams.

In many embodiments, the first component 542 of the insert 440 of FIG. 6 can further comprise an elastically deformable material and can be similar to the material of the first component 242 (FIG. 4A) of insert 140. In many embodiments, the elastically deformable material of the first component 542 can comprise a urethane material, a urethane-based material, an elastomer material, a thermoplastic material, a composite, other suitable types of material, or a combination thereof. In some embodiments, the elastically deformable material of the first component 542 of insert 440 can comprise a thermoplastic elastomer or a thermoplastic polyurethane mixed with powdered metals. In many embodiments, the powdered metals can be used to vary the weighting properties of insert 440.

In many embodiments, the retainer 544 of the insert 440 can comprise a plastically deformable material. In many embodiments, the plastically deformable material of the retainer 544 can be similar to the material of the retainer 244 (FIG. 4B) of the insert 140. In some embodiments, the plastically deformable material of the retainer 544 can comprise metal, shim stock, steel, aluminum, copper, other metals, metal alloy, plastic, or composite material. In various embodiments, the retainer 544 can comprise an elastically deformable material or a shape memory metal or metal alloy, such as nickel titanium. In some embodiments, a hardness of the retainer 544 can be approximately Shore A 55 to Shore A 70.

In some embodiments, the material of the first component 542 and the material of the retainer 544 of the insert 440 can be different from one another. In other embodiments, the material of the first component 542 and the material of the retainer 544 can comprise the same material. In some embodiments, the material of the first component 542 and the material of the retainer 544 can each be denser than a material of the golf club head 400. In other embodiments, the material of the first component 542 and the material of the retainer 544 can be the same density or less dense than the material density of the golf club head 400.

B. Flex Slot Insert

1. Single Flex Slot

Described herein is a golf club head 700 that can comprise a cavity 716, wherein the cavity 716 can be configured to receive an insert 740. As described below, the cavity 716 can comprise a face side wall 720, a rear side wall 722 opposite the face side wall 720, and bottom wall 724. The insert 740 can comprise a front surface, a back surface 754, and a bottom surface 760. The insert 740 can further comprise a flex slot 880 positioned on the bottom surface 760. The flex slot 880 can compress prior to the insert 740 being positioned within the cavity 716 of the golf club head 700. When the insert 740 is positioned in the cavity 716, the flex slot 880 expands to its original shape, causing the front surface, back surface 754, and bottom surface 760 of the insert 740 to abut against the face side wall 720, rear side wall 722, and bottom wall 724 of the cavity 716. The abutment of the surfaces of the insert 740 to the walls of the cavity 716 create a press fit of the insert, preventing dislodging during impact.

Figure 8:
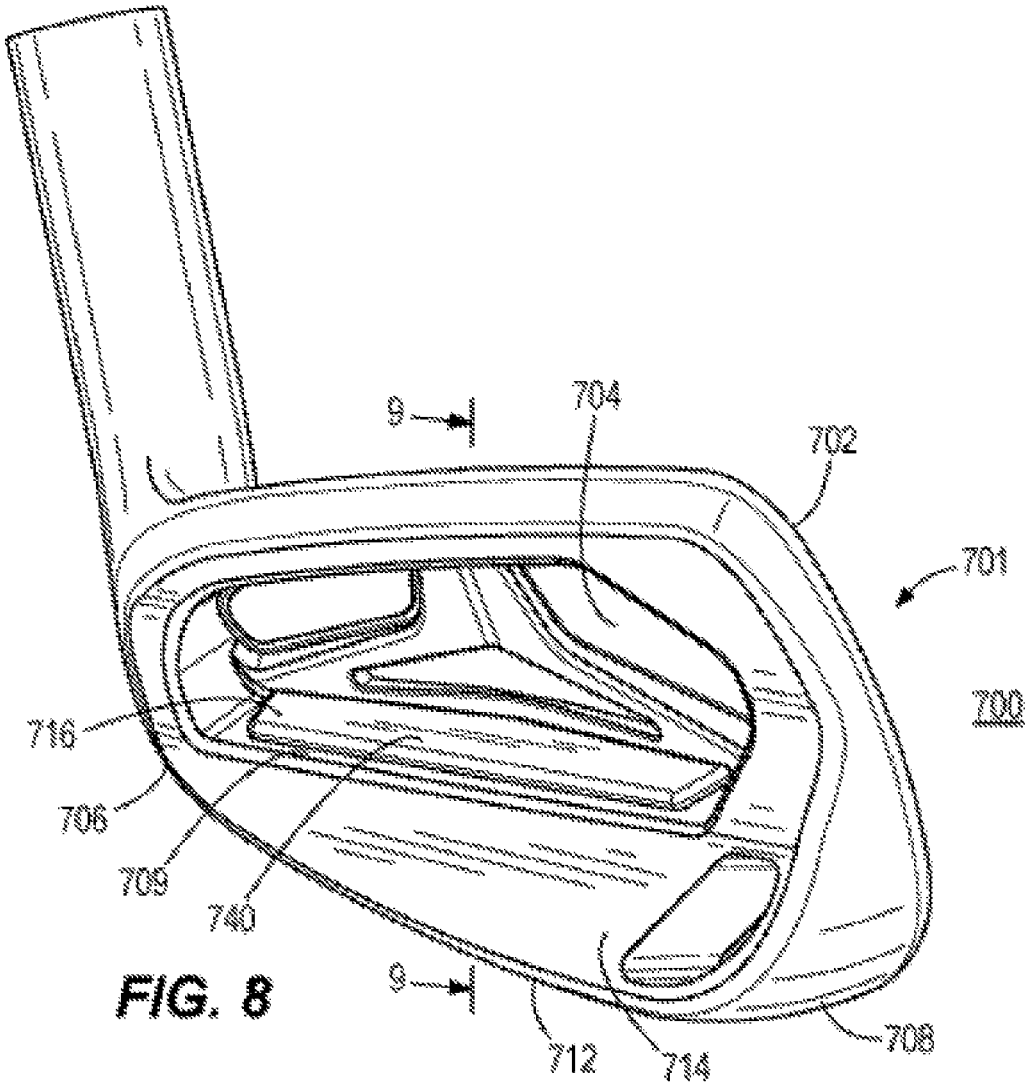
FIG. 8 depicts a back, toe-side perspective view of a golf club head according to another embodiment.

FIG. 8 illustrates a golf club head 700, which can be similar to golf club head 100 of FIG. 1, and the golf club head 400 of FIG. 4. In some embodiments, the golf club head 700 can be an iron-type golf club head. In other embodiments, the golf club head 700 can be another type of golf club head (e.g., a driver-type club head, a fairway wood-type club head, a hybrid-type club head, a wood-type club head, a wedge-type club head, or a putter-type club head). In some embodiments, the golf club head 700 can comprise a strikeface 702, a backface 704 opposite strikeface 702, a heel region 706, a toe region 708 opposite heel region 706, a sole 712, and a rear portion 714. The golf club head 700 can further comprise a cavity 716 located between backface 704 and rear portion 714. In some embodiments, golf club head 700 can comprise a hosel, which in other embodiments can be omitted. In many embodiments, rear portion 714 can be designed to look similar to a traditional muscleback iron golf club head. For example, many muscleback irons have a full back or full rear portion of a golf club head. Muscleback irons differ from non-muscleback irons in which the rear or back of the golf club head has been hollowed out to at least partially remove the muscleback, full back and/or rear portion. In some embodiments, rear portion 714 can be designed to provide a heavy or thick look to the golf club head.

Figure 9:
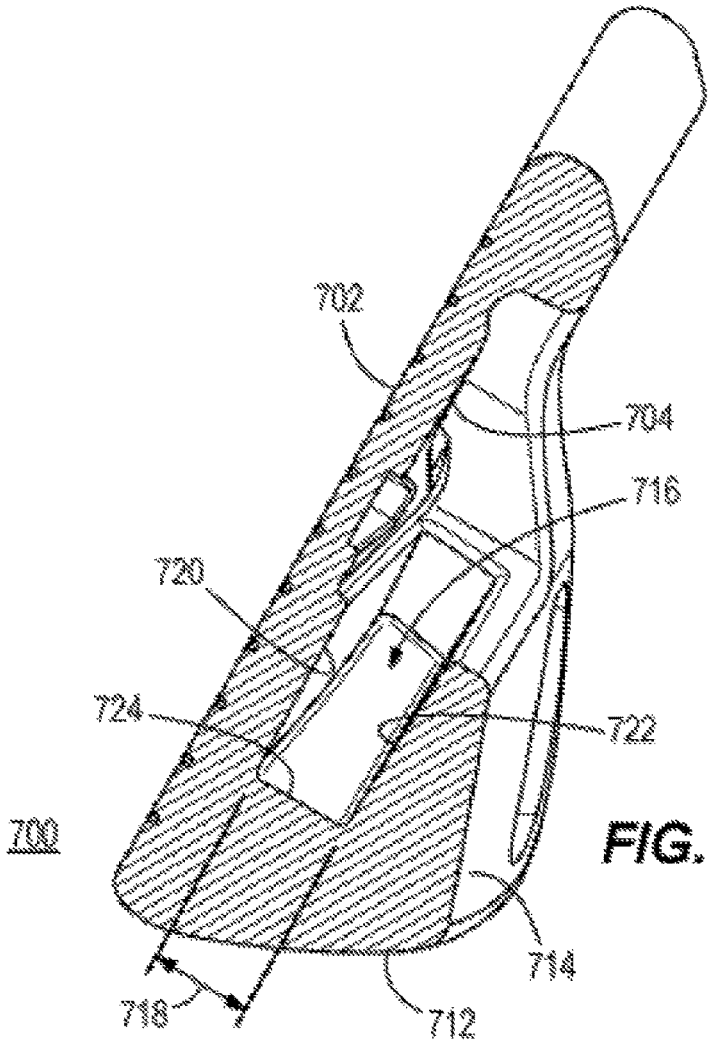
FIG. 9 depicts the golf club head of FIG. 8 along a cross-sectional line 7-7 in FIG. 8 without an insert in FIG. 8.

Illustrated in FIG. 9 is a view of the golf club head 700 of FIG. 8 at a cross-sectional line 9-9. The cavity 716 seen in FIG. 9, along line 9-9 of FIG. 8, can be similar to the cavity 116 (FIGS. 2 and 3) of the golf club head 100, and the cavity 416 (FIG. 6) of golf club head 400. A face side wall 720 can comprise a portion of the backface 704, a rear side wall 722 opposite the first side wall 720, and a bottom wall 724 positioned between the first side wall 720 and the second side wall 722 forms the cavity 716.

In many embodiments, cavity 716 can be configured to receive an insert 740, 940. In many embodiments, insert 740, 940 can dampen vibrations on the golf club head 700 after impact of a golf ball on the strikeface 702. In some embodiments, insert 740,940 can comprise a filler insert, a weight member, or a custom tuning port (CTP) weight.

Figure 10:
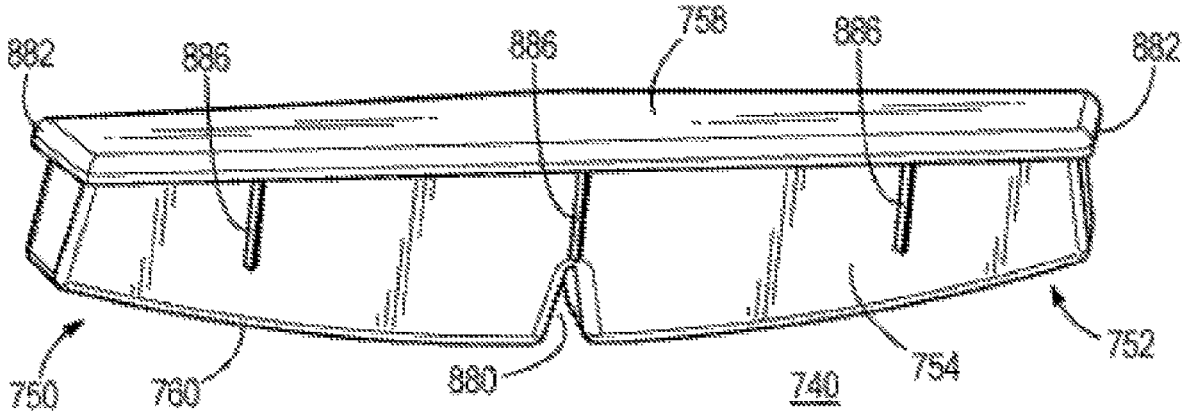
FIG. 10 depicts a back, heel-side perspective of an insert of the golf club head of FIG. 8, according to an embodiment.

FIG. 10 illustrates insert 740. The insert 740 can comprise a first end 750 proximate the heel region 706 of the golf club head 700, a second end 752 proximate the toe region 708 of the golf club head 700, a back surface 754, a front surface opposite the back surface 754, a top surface 758, and a bottom surface 760 opposite the top surface 758. When the insert 740 is positioned within the cavity 716, the back surface 754 of the insert 740 is configured to be adjacent to the rear side wall 722 of the cavity 716.

The insert 740 can further comprise a lip 882. In many embodiments, the lip 882 can protrude from the top surface 758 of the insert 740 and extends perpendicular and adjacent relative to the back surface 754 of the insert 740. In many embodiments, the lip 882 can extend along a portion of the insert 740. For example, the lip 882 can extend along the first end 750, the back surface 754, and the second end 752. In other embodiments, the lip 882 can extend along the first end 750, the back end 754, the second end 752, the back surface 754, the front surface, or any combination thereof. When the insert 740 is positioned within the cavity 716, the lip 882 of the top surface 758 abuts against a top surface 709 of the rear portion 714. The lip 882 of the top surface 758 can act as a leverage ledge to allow manufacturers to remove the insert 740 from the cavity 716 during fittings or adjustments.

In some embodiments, the insert 740 can comprise one, two, three, four, or five lips 882 stacked in horizontal layers on the insert 740. In these embodiments comprising more than one lip 882, the lip can be positioned at any location between the top surface 758, and the bottom surface 760. The lips 882 below the lip 882 extending from the top surface 758 are less in length than the lip 882 extending from the top surface 758. When the insert 740 is positioned within the cavity 716, the lip 882 extending from the top surface 758 abuts against a top surface 709 of the rear portion 714, while the remaining lips 882 create a press fit against the walls of the cavity 716.

In some embodiments wherein the insert 740 can comprise more than one lip 882, the insert 740 can comprise an undercut (not shown) positioned between the layered lips 882. Similar to the lip 882, the undercut can extend into a portion of the insert 740. For example, the one or more undercut can extend into the first end 750, the back surface 754, the second end 752, the front surface, or any combination thereof. In some embodiments, the insert 740 can comprise one, two, three, four, or five undercuts. The undercut acts as a pocket to hold adhesives. In embodiments where the insert 740 is positioned within the cavity 716 with an adhesive, the undercut allows for more adhesive to be positioned between the insert 740 and the face and rear side wall 720 and 722 of the cavity 716 for increased security of the insert 740 from dislodging during impact.

As illustrated in FIG. 10, the insert 740 can comprise a flex slot 880 extending into a portion of the bottom surface 760 of the insert 740. In some embodiments, the flex slot 880 can be positioned centrally on the bottom surface 760 in between the first end 750 and the second end 752. In other embodiments, the flex slots 880 can be positioned near the first end 750 or near the second end 752. The flex slot 880 can comprise a triangular shape. In other embodiments, the flex slot 880 can comprise any shape such as a square, a rectangle, a circle, a pentagon, or etc. In some embodiments, the insert 740 can comprise one, two, three, four, five or six flex slots 880. In these embodiments, the flex slots 880 can be spaced equidistant from one another; while in other embodiments, the flex slots 880 can be spaced any distance from one another. In some embodiments, the flex slot 980 allow the insert 740 to bend prior to being inserted within cavity 716, such that, when insert 740 is positioned within the cavity 716, insert 740 can return to its original shape. When the insert 740 returns to its original shape, a force is exerted on the toe-side wall of cavity 716 and on the heel-side wall of cavity 716 in order to secure insert 740 within cavity 716.

The insert 740 can further comprise a rib 886. The rib 886 can be positioned on the back surface 754 of the insert 740. In other embodiments, the rib 886 can be positioned onto the front surface of the insert 740, or a combination of the back surface 754 and the front surface. The rib 886 can be further positioned near the first end 750 or near the second end 752. Further, the rib 886 can be orientated perpendicular (straight up and down) relative to the top surface 758 of the insert 740. In other embodiments, the rib 886 can be orientated at different angles relative to top surface 758. The insert 740 can comprise one, two, three, four, five, six, seven, eight, nine, or ten ribs 886. In these embodiments, the ribs 886 can be equidistant from one another, or spaced any distance from one another. In some embodiments, an adhesive is applied within the cavity 716 to help secure the insert 740. In embodiments with adhesives, the rib 886 creates a press fit within the cavity 716, thereby preventing the insert 740 from shifting within the cavity 716.

In many embodiments, the insert 740 can comprise a mass. The mass of the insert 740 can range from 0.5 gram to 36 grams, 0.5 gram to 4 grams, 4 grams to 8 grams, 8 grams to 12 grams, 12 grams to 16 grams, 16 grams to 20 grams, 20 grams to 24 grams, 24 grams to 28 grams, 28 grams to 32 grams, 32 grams to 36 grams, 4 grams to 16 grams, 16 grams to 24 grams, or 24 grams to 32 grams. For example, the mass of the insert 740 can be 0.02 grams, 0.50 grams, 1 gram, 5 grams, 10 grams, 15 grams, 20 grams, 25 grams, 30 grams, or 36 grams.

In some embodiments, insert 740 can comprise a material denser than a material of the body of the golf club head 700. In other embodiments, the material of insert 740 can be the same density or less dense than the material of body of the golf club head 700. In a number of embodiments, the material of insert 740 can comprise an elastically deformable material and can be similar to the first component 242 (FIG. 4A) of the insert 140, or the first component 542 (FIG. 7A) of the insert 440. In many embodiments, the elastically deformable material of the insert 740 can comprise a polymer, a urethane material, a urethane-based material, an elastomer material, a thermoplastic material, other suitable types of material, a composite, or a combination thereof. In some embodiments, the material of the insert 740 can comprise a thermoplastic elastomer or a thermoplastic polyurethane mixed with powdered metals. In many embodiments, the powdered metals can be used to vary the weighting properties of the insert 740.

2. Multiple Flex Slots

Figure 11:
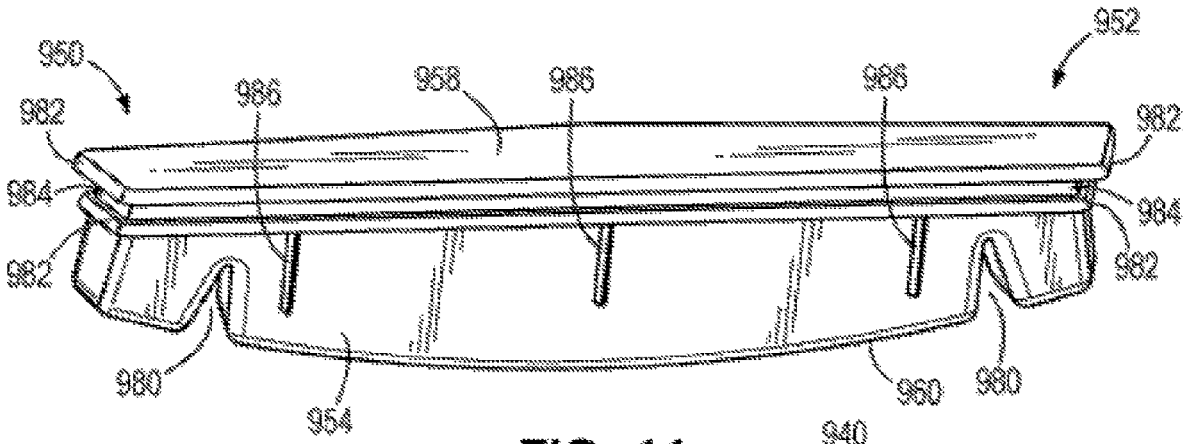
FIG. 11 depicts a back, heel-side perspective of an insert of the golf club head of FIG. 8, according to another embodiment.

Described herein is the golf club head 700 that can comprise the cavity 716, wherein the cavity 716 can be configured to receive an insert 940. As described above, the cavity 716 can comprise the face side wall 720, the rear side wall 722 opposite the face side wall 720, and the bottom wall 724. FIG. 11 illustrates insert 940, which can be similar to insert 740. The insert 740 can comprise a front surface, a back surface 954, and a bottom surface 960. The insert 940 can further comprise two flex slots 980 positioned on the bottom surface 960, with one flex slot 980 near the first end 950 of the insert 940 and a second flex slot 980 near the second end 952 of the insert 940. The flex slots 980 can compress prior to the insert 940 being positioned within the cavity 716 of the golf club head 700. When the insert 940 is positioned in the cavity 716, the flex slots 980 expands to its original shape, causing the front surface, the back surface 954 and the bottom surface 960 of the insert 940 to abut against the face side wall 720, rear side wall 722, and bottom wall 724 of the cavity 716. The abutment of the surfaces of the insert 940 to the walls of the cavity 716 create a press fit of the insert, preventing dislodging during impact.

The insert 940 can comprise a first end 950 proximate the heel region 706, a second end 952 proximate the toe region 708, a back surface 954, a front surface, a top surface 958, and a bottom surface 960. When the insert 940 is positioned within the insert 716, the back surface 954 is configured to be adjacent to the rear side wall 722 of the cavity 716.

The insert 940 can comprise a lip 982. In some examples, the lip 982 can protrude from the top surface 958 of the insert 940, and extend perpendicular and adjacent relative to the back surface 954 of the insert 940. In many embodiments, the lip 982 can extend along a portion of the insert 940. For example, the lip 982 can extend along the first end 950, the back surface 954, and the second end 952. In other embodiments, the lip 982 can extend along the first end 950, the front end 954, the second end 952, the back surface 954, the front surface, or any combination thereof. When the insert 940 is positioned within the cavity 716, the lip 982 of the top surface 958 abuts against a top surface 709 of the rear portion 714. The lip 982 of the top surface 958 can act as a leverage ledge to allow manufacturers to remove the insert 940 from the cavity 716 during fittings or adjustments.

In some embodiments, the insert 940 can comprise one, two, three, four, or five lips 982 stacked in horizontal layers on the insert 940. In these embodiments comprising more than one lip 982, the lip can be positioned at any location between the top surface 958, and the bottom surface 960. The lips 982 below the lip 982 extending from the top surface 958 are less in length than the lip 982 extending from the top surface 958. When the insert 940 is positioned within the cavity 716, the lip 982 extending from the top surface 958 abuts against a top surface 709 of the rear portion 714, while the remaining lips 982 create a press fit against the walls of the cavity 716. The press fit created by the remaining lips 982 help secure the insert 940 within the cavity 716 of the golf club head 700.

In some embodiments wherein the insert 940 can comprise multiple lips, the insert can further comprise an undercut 984. In many embodiments, the undercut 984 of the insert 940 can be positioned between two lips 982 extending from the top surface 958. In other embodiments, the undercut 984 is positioned in between two lips 982. Similar to the lip 982, the undercut 984 can extend along a portion of the insert 940. For example, the undercut 984 can extend along the first end 950, the back surface 954, and the second end 952. In other embodiments, the undercut 984 can extend along the first end 950, the back surface 954, the second end 952, the front surface, or any combination thereof. In some embodiments, the insert 940 can comprise one, two, three, four, or five undercuts 984. In embodiments wherein the insert 940 is positioned within the cavity 716 with an adhesive, the undercut 984 acts as a pocket, allowing for more adhesive to be positioned between the insert 940 and the face and rear side wall 720, and 722 of the cavity 716 for increased security of the insert 940 from dislodging during impact.

As illustrated in FIG. 11, the insert 940 can comprise two flex slots 980 extending into a portion of the bottom surface 960. One of the two flex slots 980 is positioned on the bottom surface 960 near the first end 950, while the second of the two flex slots 980 is positioned on the bottom surface 960 near the second end 952. In other embodiments, the flex slot 980 can be positioned centrally on the bottom surface 960, near the first end 950, or near the second end 952. Further illustrated in FIG. 11, the flex slots 980 can comprise a triangular shape. In other embodiments, the flex slot 980 can comprise any shape such as a triangle, a square, a rectangle, a circle, a pentagon, or any other shape. In other embodiments, the insert 940 can comprise one, two, three, four, five or six flex slots 980. In these embodiments, the flex slots 980 can be spaced equidistant from one another; while in other embodiments, the flex slots 980 can be spaced any distance from one another. In some embodiments, the flex slot 980 allow the insert 940 to bend prior to being inserted within cavity 716, such that, when insert 940 is positioned within the cavity 716, insert 940 can return to its original shape. When the insert 940 returns to its original shape, a force is exerted on the toe-side wall of cavity 716 and on the heel-side wall of cavity 716 in order to secure insert 940 within cavity 716.

As illustrated in FIG. 11, the insert 940 can further comprise a rib 986. In some embodiments, the rib 986 can be positioned onto the back surface 954 of the insert 940. In other embodiments, the rib 986 can be positioned on the front surface of the insert, or a combination of the back surface 954 and the front surface. The rib 986 can be further positioned near the first end 950, near the second end 952, or centered. Further, as illustrated in FIG. 11, the rib 986 is orientated perpendicular (straight up and down) relative to the top surface 958 of the insert 940. In other embodiments, the rib 986 can be orientated at an angle relative to the top surface 958 (e.g., 30 degrees, 45 degrees, 60 degrees, 75 degrees, etc.). The insert 940 can comprise one, two, three, four, five, six, seven, eight, nine, or ten ribs 986. In these embodiments, the ribs 986 can be equidistant from one another, or spaced any distance from one another. In embodiments wherein an adhesive is applied within the cavity 716 to help secure the insert 940, the at least one rib 986 creates a press fit, thereby preventing the insert 940 from shifting within the cavity 716.

In many embodiments, the insert 140 can comprise a mass. The mass of the insert 940 can range from 0.5 gram to 36 grams, 0.5 gram to 4 grams, 4 grams to 8 grams, 8 grams to 12 grams, 12 grams to 16 grams, 16 grams to 20 grams, 20 grams to 24 grams, 24 grams to 28 grams, 28 grams to 32 grams, 32 grams to 36 grams, 4 grams to 16 grams, 16 grams to 24 grams, or 24 grams to 32 grams. For example, the mass of the insert 940 can be 0.02 grams, 0.50 grams, 1 gram, 5 grams, 10 grams, 15 grams, 20 grams, 25 grams, 30 grams, or 36 grams.

In some embodiments, insert 940 can comprise a material denser than a material of the body of the golf club head 700. In other embodiments, the material of insert 940 can be the same density or less dense than the density of the body of the golf club head 700. In a number of embodiments, the material of insert 940 can comprise an elastically deformable material and can be similar to first component 242 (FIG. 4A) of inert 140, first component 542 (FIG. 7A) of inert 440, or insert 740. In many embodiments, the elastically deformable material of insert 940 can comprise a polymer, a urethane material, a urethane-based material, an elastomer material, a thermoplastic material, other suitable types of material, a composite, or a combination thereof. In some embodiments, the material of insert 740 can comprise a thermoplastic elastomer or a thermoplastic polyurethane mixed with powdered metals. In many embodiments, the powdered metals can be used to vary the weighting properties of insert 940.

C. Friction Retention Insert

1. Vertical Slit

Described herein is a golf club head 1200 that can comprise a cavity 1216. As described below, the cavity 1216 can comprise a bottom wall 1218 and a side wall 1220 wherein a divider 1222 can extend from the bottom wall 1218. The divider 1222 can comprise an aperture 1228. The cavity 1216 is configured to receive an insert 1240. The insert 1240 can comprise a back portion 1252, a front portion 1262, separated by a slit 1260, and an insert aperture 1270 concentric through the back and front portion 1252, and 1262. The slit 1260 of the insert 1240 can receive the divider 1222, wherein back portion 1252 and the front portion 1262 are positioned on either side of the divider 1222. A fastener 1274 can be positioned through the insert aperture 1270 and the aperture 1228 of the divider 1222 to compress the insert 1240 to the divider 1222, wherein surface friction is created between the surfaces of the insert 1240 and divider 1222. The surface friction helps secure the insert 1240 within the cavity, and prevents dislodging.

Figure 12:
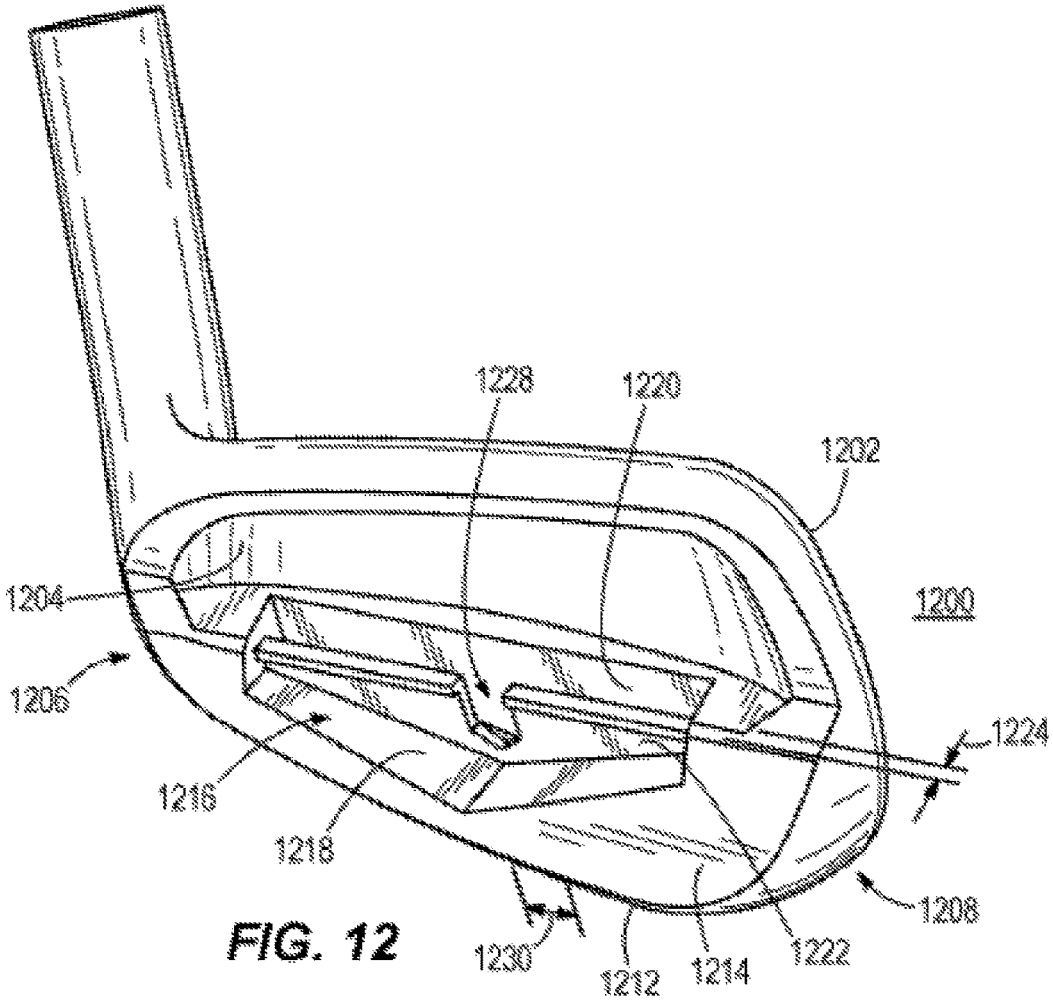
FIG. 12 depicts a back, toe-side perspective view of a golf club head according to another embodiment.

FIG. 12 illustrates a golf club head 1200, which can be similar to golf club heads 100, 400, and 700. In some embodiments, golf club head 1200 can be an iron-type golf club head. In other embodiments, the golf club head 1200 can be another type of golf club head (e.g., a driver-type club head, a fairway wood-type club head, a hybrid-type club head, a wood-type club head, a wedge-type club head, or a putter-type club head.) In some embodiments, golf club head 1200 can comprise a strikeface 1202, a backface 1204 opposite the strikeface 1202, a heel region 1206, a toe region 1208 opposite the heel region 1206, a sole 1212, and a rear portion 1214. The golf club head 1200 can further comprise a cavity 1216 located between the backface 1204 and rear portion 1214.

The cavity 1216 can comprise a bottom wall 1218, and a side wall 1220. In some embodiments, the side wall 1220 is offset from the backface 1204 of the golf club head 1200. In other embodiments, the side wall 1220 can comprise a portion of the backface 1204. In many embodiments, the golf club head 1200 can further comprise a divider 1222 extending from the bottom wall 1218 of the cavity 1216. The divider 1222 can extend the entire length of the cavity 1216 from the heel region 1206 toward the toe region 1208. In other embodiments, the divider 1222 can extend a portion of the length of the cavity 1216. The height of the divider 1222 can extend up to the height of the cavity 1216.

In some embodiments, the divider 1222 can be parallel with the side wall 1220 of the cavity 1240. In other embodiments, the divider 1222 can be orientated at an angle relative to the side wall 1220 of the cavity 1240. The divider 1222 separates the cavity 1216 into a first pocket 1211 adjacent to the side wall 1220, and a second pocket 1213 on the other side of the first pocket 1211. In some embodiments where the divider 1222 is oriented at an angle relative to the side wall 1220, the first pocket 1211 is greater in width on the toe end 1208. In other embodiments where the divider 1222 is oriented at an angle relative to the side wall 1220, the first pocket 1211 is greater in width on the heel end 1206.

The divider 1222 can further comprise a thickness 1224. The thickness 1224 of the divider 1222 remains constant through the length of the divider 1222 extending from the heel end 1206 toward the toe end 1208. In other embodiments, the divider 1222 can vary in width extending from the heel end 1206 of the golf club head 1200 toward the toe end 1208 of the golf club head 1200. The thickness 1224 of the divider 1222 can further remain constant extending from the bottom wall 1218 toward the top of the golf club head 1200. In some embodiments, the thickness 1224 of the divider 1222 is 0.070 inch. In other embodiments, the thickness 1224 of the divider 1222 can range between 0.050 inch to 0.100 inch, 0.055 inch to 0.075 inch, 0.060 inch to 0.080 inch, 0.065 inch to 0.085 inch, 0.070 inch to 0.090 inch, or 0.075 inch to 0.095 inch. For example, the thickness 1224 of the divider 1222 can be 0.050 inch, 0.055 inch, 0.060 inch, 0.065 inch, 0.070 inch, 0.075 inch, 0.080 inch, 0.085 inch, 0.090 inch, 0.095 inch, or 0.100 inch.

Further, the divider 1222 can comprise an aperture 1228. In one embodiment, the aperture 1228 is located at or near the center of the divider 1222. In other embodiments, the aperture 1228 can be positioned at any location. For example, the aperture 1228 can be positioned near the heel region 1206, or near the toe region 1208 of the golf club head 1200. In other embodiments, the divider 1222 can comprise one, two, three, four, or five apertures 1228. In these embodiments, the apertures 1228 can be positioned equidistant from one another, at any distance from one another, centered on the divider 1222, near the heel region 1206, near the toe region 1208, or at any location on the divider 1222 For example, the divider 1222 can comprise one aperture near the heel region 1206, and a second aperture near the toe region 1208.

The aperture 1228 can comprise a width 1230. In one embodiment, the width 1230 of the aperture 1228 is 0.25 inch. In other embodiments, the width 1230 of the aperture 1228 can range between 0.100 inch to 0.250 inch, 0.100 inch to 0.130 inch, 0.130 inch to 0.160 inch, 0.160 inch to 0.190 inch, 0.190 inch to 0.230 inch, or 0.230 inch to 0.250 inch. For example, the width 1230 of the aperture can be 0.100 inch, 0.125 inch, 0.150 inch, 0.175 inch, 0.200 inch, 0.225 inch, or 0.250 inch.

Figure 13:
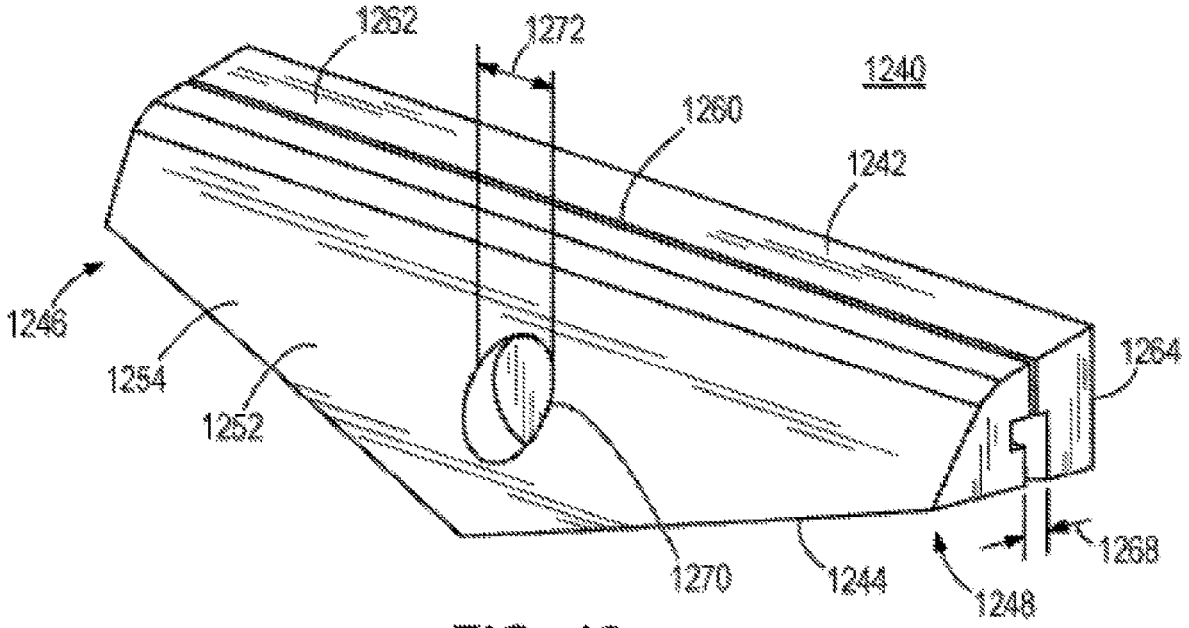
FIG. 13 depicts a back, toe-side perspective of an insert of the golf club head of FIG. 12.
Figure 14:
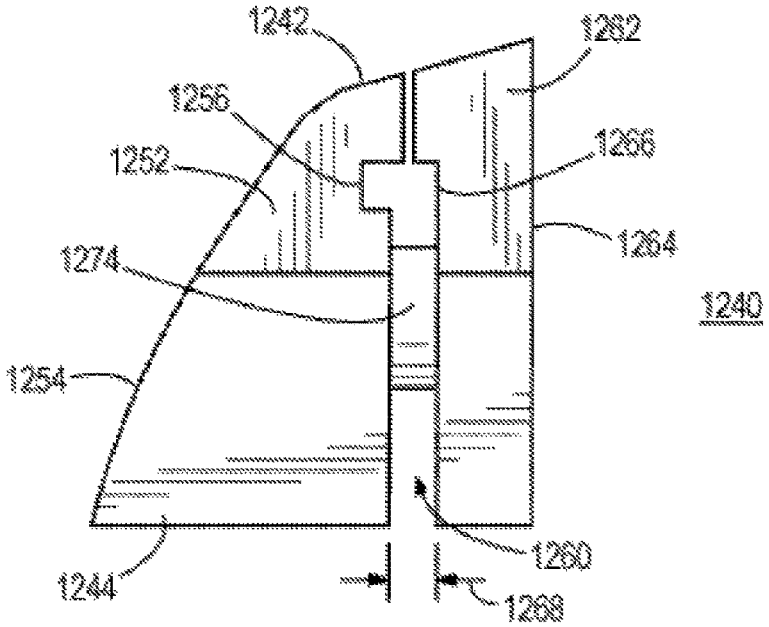
FIG. 14 depicts a side view of the insert of the golf club head of FIG. 12.

In many embodiments, the cavity 1216 can be configured to receive an insert 1240. The insert 1240 is complementary in shape and dimensions to the cavity 1216 of the golf club head 1200. As illustrated in FIGS. 13 and 14, the insert 1240 can comprise a top 1242, a base 1244, a first end 1246 proximate the heel region 1206, and a second end 1248 proximate the toe region 1208. When the insert 1240 is positioned within the cavity 1216, the top 1242 of the insert 1240 is a horizontal planar surface extending from the first end 1246 toward the second end 1248.

As illustrated in FIG. 14, the insert 1240 can further comprise a first component or back portion 1252, and a second component or front portion 1262. The back portion 1252 and the front portion 1262 are separated by slit 1260. The back portion 1252 can comprise a back outer surface 1254 and a back inner surface 1256 adjacent to the slit 1260. The front portion 1262 can comprise a front outer surface 1264 and a front inner surface 1266 adjacent to the slit 1260. When the insert 1240 is positioned within the cavity 1216, the front portion 1262 is positioned within the first pocket 1211, and the back portion 1252 is positioned within the second pocket 1213. More specifically, when the insert 1240 is positioned within the cavity 1216, the back inner surface 1256 of the back portion 1252 and the front inner surface 1266 of the front portion 1262 abut the divider 1222. Further, the front outer surface 1264 is adjacent to the side wall 1220 of the cavity 1216.

In some embodiments, the slit 1260 can extend from the base of the insert 1240 toward the top 1242 of the insert 1240. For example, the slit 1260 can extend from 50% to 55%, 55% to 60%, 60% to 65%, 65% to 70%, 70% to 75%, 75% to 80%, 80% to 85%, 85% to 90%, 90% to 95%, or 95% to 100% of the height of the insert 1240 from the base 1244.

The slit 1260 can comprise a width 1268 measured from the front inner surface 1266 of the front portion 1262 to the rear inner surface 1556 of the back portion 1252. In some embodiments, the width 1268 of the slit 1260 can remain constant starting from the base 1244 and extending into a portion of the insert 1240. In other embodiments, the width 1268 of the slit 1260 can vary starting from the base 1244 and extending into a portion of the insert 1240. For example, the width 1268 of the slit 1260 can decrease as the slit 1260 extends toward the top 1242, increase as the slit 1260 extends toward the top 1242, or any variation thereof as the slit 1260 extends toward the top 1242. In some embodiments, the width 1268 of the slit 1260 can be between 0.050 inch to 0.115 inch, 0.055 inch to 0.075 inch, 0.065 inch to 0.085 inch, 0.075 inch to 0.095 inch, 0.085 inch to 0.105 inch, or 0.095 inch to 0.115 inch. For example, the width 1268 of the slit 1260 can be 0.050 inch, 0.055 inch, 0.060 inch, 0.065 inch, 0.070 inch, 0.075 inch, 0.080 inch, 0.085 inch 0.090 inch, 0.095 inch, 0.100 inch, 0.105 inch, 0.110 inch, or 0.115 inch. According to one example, the width 1268 of the slit 1260 is 0.070 inch. In embodiments where the slit 1260 extends into a portion of the insert 1240, the width 1268 of the slit 1260 can be equal to or slightly greater than the thickness 1224 of the divider 1222.

In some embodiments, the slit 1260 extends parallel to the front outer surface 1264 of the front portion 1262. In other embodiments, the slit 1260 can extend at an angle relative to the front outer surface 1264 of the front portion 1262. For example, when the slit 1260 extends at an angle relative to the front outer surface 1264 of the front portion 1262, the top 1242 of the front portion 1262 can be less thick or more thick than the base 1244 of the front portion 1262. The slit 1260 can extend up to 25 degrees toward or away from the front outer surface 1264 of the front portion 1262 of the insert 1240. For example, the slit can be angled at 3, 6, 9, 12, 15, 18, 21, or 25 degrees toward or away from the front outer surface 1264 of the front portion 1262. In other embodiments, the slit 1260 can extend at an angle relative to the first end 1246. For example, when the slit 1260 extends at an angle relative to the first end 1246, the second end 1248 of the front portion 1262 can be less thick or more thick than the first end 1246 of the front portion 1262. The slit 1260 can extend up to 25 degrees toward or away from the first end 1246 of the insert 1240. For example, the slit can be angled at 3, 6, 9, 12, 15, 18, 21, or 25 degrees toward or away from the first end 1246 of the insert 1240.

The insert 1240 further can comprise an insert aperture 1270. The insert aperture 1270 extends through the back portion 1252 and the front portion 1262, wherein the insert aperture 1270 in the back portion 1252 is concentric with the insert aperture 1270 in the front portion 1262 of the insert 1240. In one embodiment, the insert aperture 1270 is positioned centrally or at the midpoint between the first end 1246 and the second end 1248, and between the top 1242 and the base 1244. In other embodiments, the insert aperture 1270 of the insert 1240 can be positioned toward the first end 1246, toward the second end 1248, toward the top 1242 or toward the base 1244.

As illustrated in FIG. 13, the insert 1240 can comprise one insert aperture 1270. In other embodiments, the insert 1240 can comprise at one, two, three, four, or five insert apertures 1270. In many embodiments, the number of insert apertures 1270 corresponds to the number of apertures 1228 of the divider 1222. The insert aperture 1270 corresponds in location to the position of the aperture 1228 of the divider 1222, wherein the insert aperture 1270 is concentric to the aperture 1228 of the divider 1222 when the insert 1240 is positioned within the cavity 1216.

The insert aperture 1270 can comprise a diameter 1272. According to one embodiment, the insert aperture 1270 can comprise a diameter of 0.150 inch. In other embodiments, the diameter 1272 of the insert aperture 1270 can range between 0.100 inch to 0.250 inch, 0.100 inch to 0.130 inch, 0.130 inch to 0.160 inch, 0.160 inch to 0.190 inch, 0.190 inch to 0.230 inch, or 0.230 inch to 0.250 inch. For example, the width 1230 of the insert aperture 1270 can be 0.100 inch, 0.125 inch, 0.150 inch, 0.175 inch, 0.200 inch, 0.225 inch, or 0.250 inch. In many embodiments, the diameter 1272 of the insert aperture 1270 is the same as the width 1230 of the aperture 1228 of the divider 1222.

The inert 1240 can further comprise a mass. The mass of the insert 1240 can range from 0.02 gram to 32 grams, 0.02 gram to 0.40 gram, 0.040 gram to 0.80 gram, 0.080 gram to 3 grams, 3 grams to 9 grams, 9 grams to 15 grams, 15 grams to 21 grams, 21 grams to 27 grams, 27 grams to 32 grams, 0.02 gram to 10 grams, 10 grams to 20 grams, or 20 grams to 32 grams. For example, the mass of the insert 1240 can be 0.02 grams, 0.50 grams, 1 gram, 5 grams, 10 grams, 15 grams, 20 grams, 25 grams, 30 grams, or 36 grams.

In some embodiments, the back portion 1252 and the front portion 1262 of the insert 1240 can comprise the same mass. In other embodiments, the back portion 1252 can comprise less mass than the front portion 1262 of the insert 1240. For example, the back portion 1252 can comprise a mass ranging from 0.02 gram to 0.80 gram, 0.080 gram to 4 grams, 4 grams to 8 grams, 8 grams to 12 grams, or 12 grams to 15 grams (e.g., 0.02 grams, 0.50 grams, 1 gram, 5 grams, 10 grams, or 15 grams), while the front portion 1262 can comprise a mass ranging from 7 grams to 32 grams, 7 grams to 15 grams, 15 grams to 18 grams, 18 grams, to 23 grams, 23 grams to 28 grams, 28 grams to 32 grams (e.g., 7 grams, 15 grams, 20 grams, 25 grams, 30 grams, or 32 grams). In other embodiments, the back portion 1252 can comprise more mass than the front portion 1262 of the insert 1240. For example, the front portion 1262 can comprise a mass ranging from 0.02 gram to 0.80 gram, 0.080 gram to 4 grams, 4 grams to 8 grams, 8 grams to 12 grams, or 12 grams to 15 grams (e.g., 0.02 grams, 0.50 grams, 1 gram, 5 grams, 10 grams, or 15 grams), while the back portion 1252 can comprise a mass ranging from 7 grams to 32 grams, 7 grams to 15 grams, 15 grams to 18 grams, 18 grams, to 23 grams, 23 grams to 28 grams, 28 grams to 32 grams (e.g., 7 grams, 15 grams, 20 grams, 25 grams, 30 grams, or 32 grams).

The insert aperture 1270 can receive a fastener 1274. The fastener 1274 can comprise a self-threaded screw, a co-molded thread, screw, rivets (solid head rivets or blind rivets) or any other type of fastener. The fastener 1274 can be one fastener 1274, two fasteners 1274, three fasteners 1274, four fasteners 1274, or five fasteners 1274. In many embodiments, the number of fastener 1274 corresponds with the number of insert aperture 1270. When the insert 1240 is positioned within the cavity 1216 of the golf club head 1200, the fastener 1274 is positioned through the insert aperture 1270 located on the back portion 1252 of the insert 1240, extends through the aperture 1228 of the divider 1222 and through the insert aperture 1270 in the front portion 1262 of the insert 1240.

When the fastener 1274 positioned within the insert aperture 1270, and the aperture 1228 of the divider 1222 helps secure and compress the insert 1240 against the divider 1222 of the cavity 1216. The compression of the insert 1240 against the divider 1222 creates a surface friction between the back inner surface 1256 of the back portion 1252 of the insert 1240 and the front inner surface 1266 of the front portion 1262 of the insert 1240 against the divider 1222. The combination of the fastener 1274 and surface friction prevents the insert 1240 from dislodging from the cavity 1216, thereby securing the insert 1240 within the cavity 1216.

In many embodiments, the insert 1240 can comprise a plastically deformable material. In some embodiments, the plastically deformable material of the insert 1240 can comprise metal, tungsten, aluminum, titanium, vanadium, chromium, cobalt, nickel, other metals, shim stock, steel, copper, metal alloy, plastic, or composite material. In various embodiments, insert 1240 can comprise an elastically deformable material or a shape memory metal or metal alloy, such as nickel titanium.

In some embodiments, the material of the front portion 1262 and the material of the back portion 1252 of the insert 1540 can be different from one another. In other embodiments, the material of the front portion 1262 and the material of the back portion 1252 can comprise the same material. In some embodiments, the material of the front portion 1262 and the material of the back portion 1252 can each be denser than a material of the golf club head 1200. In other embodiments, the material of the front portion 1262 and the material of the back portion 1252 can be the same density or less dense than the material density of the golf club head 1200.

2. Horizontal Slit

Described herein is a golf club head 1500 that can comprise a cavity 1516. As described below, the cavity 1516 can comprise a bottom wall 1518 and a side wall 1520, wherein a divider 1522 can extend from the side wall 1520. The divider can comprise an aperture 1528. The insert 1540 can comprise a top portion 1552, a bottom portion 1562, separated by a slit 1560, and an insert aperture 1570 concentric through the top and bottom portion 1552, and 1562. The slit 1560 of the insert 1540 can receive the divider 1522, wherein the top portion 1552, and the bottom portion 1562 are positioned on either side of the divider 1522. A fastener 1574 can be positioned through the insert aperture 1570 and the aperture 1528 of the divider 1522 to compress the insert 1540 to the divider 1522, wherein surface friction is created between the surfaces of the insert 1540 and divider 1522. The surface friction helps secure the insert 1540 within the cavity, and prevents dislodging.

Figure 15:
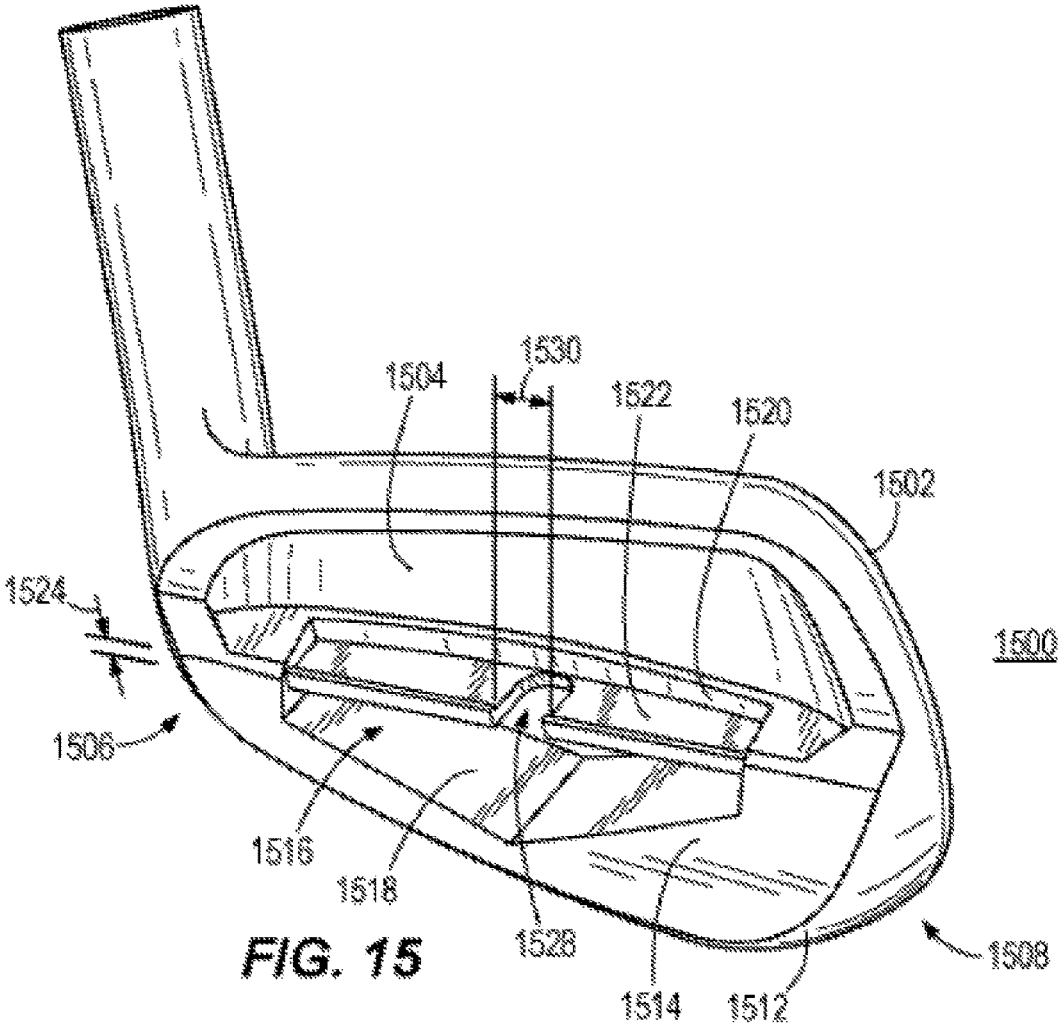
FIG. 15 depicts a back, toe-side perspective view of a golf club head according to another embodiment.

FIG. 15 illustrates a golf club head 1500, which can be similar to golf club heads 100, 400, 700, and 1200. In many embodiments, golf club head 1500 can be an iron-type golf club head. In other embodiments, the golf club head 1500 can be another type of golf club head, such as a driver-type club head, a fairway wood-type club head, a hybrid-type club head, a wood-type club head, a wedge-type club head, or a putter-type club head. In some embodiments, the golf club head 1500 can comprise a strikeface 1502, a backface 1504 opposite the strikeface 1502, a heel region 1506, a toe region 1508 opposite the heel region 1506, a sole 1512, and a rear portion 1514. The golf club head 1500 can further comprise a cavity 1516 located between the backface 1504 and the rear portion 1514.

The cavity 1516 can comprise a bottom wall 1518, and a side wall 1520. In some embodiments, the bottom wall 1518 can be a flat planar surface; while in other embodiments, the bottom wall 1518 can be a combination or multiple planar surfaces. In some embodiments, the side wall 1520 is offset from the backface 1504 of the golf club head 1500. In other embodiments, the side wall 1520 can comprise a portion of the backface 1504.

The cavity 1516 can further comprise a divider 1522 similar to the divider 1222 of the golf club head 1200. The divider 1522 can extend perpendicularly from the side wall 1520 of the cavity 1516. In other embodiments, the divider 1522 can extend at an angle relative to the side wall 1520 of the cavity 1516. The divider 1522 can extend centrally on the side wall 1520, near the top of the side wall 1520, or near the bottom wall 1518. The divider 1522 can extend the entire length of the cavity 1516 from the heel region 1506 toward the toe region 1508. In some embodiments, the divider 1522 can extend the entire length of the cavity 1516. In other embodiments, the divider 1522 can extend a portion of the length of the cavity 15616. The height of the divider 1522 can extend up to the width of the cavity 1516.

The divider 1522 can further be orientated perpendicular to the side wall 1520 of the cavity 1516. In other embodiments, the divider 1522 can be orientated at an angle relative to the sidewall 1520 of the cavity 1516. The divider 1522 separates the cavity 1516 into a first pocket 1511 adjacent to the bottom wall 1518, and a second pocket 1513 on the other side of the divider 1522, opposite the first pocket 1211.

The divider 1522 can comprise a thickness 1524. In some embodiments, the thickness 1524 of the divider 1522 remain constant throughout the length of the divider 1522 extending from the heel end 1506 toward the toe end 1508 of the golf club head 1500. In other embodiments, the thickness 1524 can vary throughout the length of the divider 1522 extending from the heel end 1506 toward the toe end 1508. The thickness 1524 of the divider 1522 can further remain constant from the side wall 1520 extending away from the side wall 1520. In some embodiments, the thickness 1524 of the divider 1522 is 0.070 inch. In other embodiments, the thickness 1524 of the divider 1522 can range between 0.050 inch to 0.100 inch, 0.055 inch to 0.075 inch, 0.060 inch to 0.080 inch, 0.065 inch to 0.085 inch, 0.070 inch to 0.090 inch, or 0.075 inch to 0.095 inch. For example, the thickness 1524 of the divider 122 can be 0.050 inch, 0.055 inch, 0.060 inch, 0.065 inch, 0.070 inch, 0.075 inch, 0.080 inch, 0.085 inch, 0.090 inch, 0.095 inch, or 0.100 inch.

The divider 1522 can further comprise an aperture 1528. In one embodiment, the aperture 1528 is located at or near the center of the divider 1522. In other embodiments, the aperture 1528 can be positioned at any location. For example, the aperture 1528 can be positioned near the heel region 1506, or near the toe region 1508 of the golf club head 1500. In other embodiments, the divider 1522 can comprise one, two, three, four, or five apertures 1528. In these embodiments, the apertures 1528 can be positioned equidistant from one another, at any distance from one another, centered on the divider 1522, near the heel region 1506, near the toe region 1508, or at any location on the divider 1522 For example, the divider 1522 can comprise one aperture near the heel region 1506, and a second aperture near the toe region 1508.

The aperture 1528 can further comprise a width 1530. In one embodiment, the width 1530 of the aperture 1528 is 0.25 inch. In other embodiments, the width 1530 of the aperture 1538 can range between 0.100 inch to 0.250 inch, 0.100 inch to 0.130 inch, 0.130 inch to 0.160 inch, 0.160 inch to 0.190 inch, 0.190 inch to 0.230 inch, or 0.230 inch to 0.250 inch. For example, the width 1530 of the aperture can be 0.100 inch, 0.125 inch, 0.150 inch, 0.175 inch, 0.200 inch, 0.225 inch, or 0.250 inch.

Figure 16:
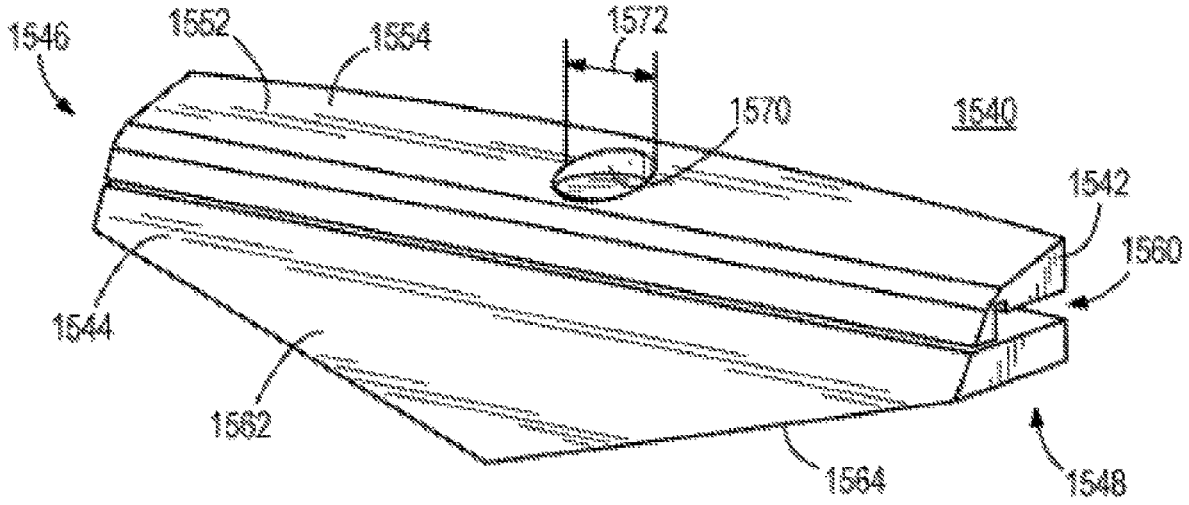
FIG. 16 depicts a back, toe-side perspective of an insert of the golf club head of FIG. 15.
Figure 17:
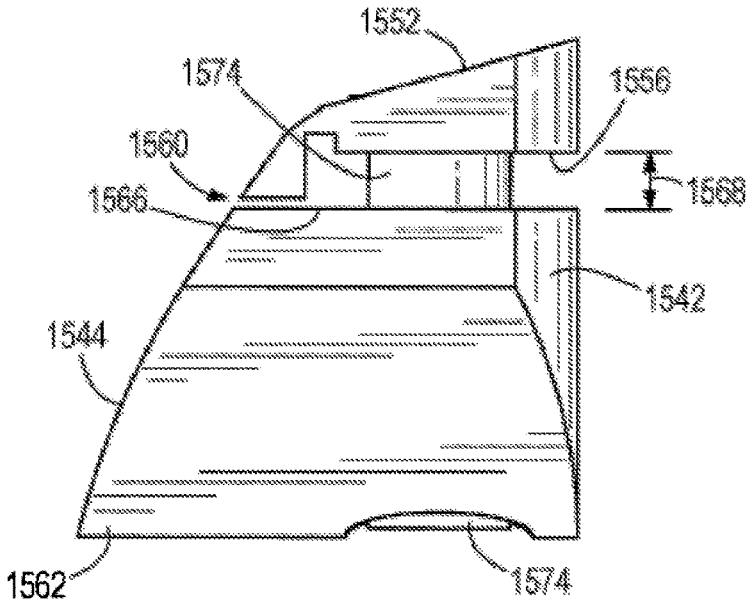
FIG. 17 depicts a side view of the insert of the golf club head of FIG. 15.

In many embodiments, the cavity 1516 can be configured to receive an insert 1540. The insert 1540 is complementary in shape and dimensions to the cavity 1516 of the golf club head 1500. The insert 1540 is similar to the insert 1240 of the golf club head 1200. As illustrated in FIGS. 16 and 17, the insert 1540 can comprise a first end 1546 proximate the heel region 1506, a second end 1548 proximate the toe region 1508, a back surface 1544, a front surface 1542, a top portion 1552 (or first component), a bottom portion 1562 (or second component), and a slit 1560 separating the top portion 1552 and bottom portion 1562.

From a rear view of the insert 1540 (FIG. 16), the top portion 1552 is generally rectangular in shape. The top portion 1552 of the insert 1540 can comprise a top outer surface 1554, and a top inner surface 1556. As illustrated in FIG. 16, the bottom portion 1554 is generally pentagonal in shape. The bottom portion of the insert 1540 can comprise a bottom inner surface 1566, and a bottom outer surface 1564. When the insert 1540 is positioned within the cavity 1516, the bottom portion 1554 is positioned within the first pocket 1511, and the top portion 1552 is positioned within the second pocket 1513. More specifically, when the insert 1540 is positioned within the cavity 1516, the top inner surface 1556 of the top portion 1552 and the bottom inner surface 1566 of the bottom portion 1562 abut the divider 1522.

In some embodiments, the slit 1560 can extend from the rear surface 1542 of the insert 1540 toward the back surface 1544 of the insert 1540. For example, the slip 1560 can extend 50% to 55%, 55% to 60%, 60% to 65%, 65% to 70%, 70% to 75%, 75% to 80%, 80% to 85%, 85% to 90%, 90% to 95%, or 95% to 100% into the insert 1540 from the front surface 1542.

The slit 1560 can comprise a width 1568 measured from the top inner surface 1556 of the top portion 1552 to the bottom inner surface 1566 of the bottom portion 1562. In some embodiments, the width 1568 of the slit 1560 can remain constant starting from the rear surface 1542 and extending into a portion of the insert 1540. In other embodiments, the width 1568 of the slit 1560 can vary extending from the rear surface 1542 and into a portion of the insert 1540. For example, the width 1568 can decrease, increase, or any variation thereof as the slit 1560 as the slit 1560 extends toward to the back surface 1544 of the insert 1540. In some embodiments, the width 1568 of the slit 1560 can be between at least 0.050 inch to 0.115 inch, 0.055 inch to 0.075 inch, at least 0.065 inch to 0.085 inch, at least 0.075 inch to 0.095 inch, at least 0.085 inch to 0.105 inch, or at least 0.095 inch to 0.115 inch. For example, the width 1268 of the slit 1260 can be 0.050 inch, 0.055 inch, 0.060 inch, 0.065 inch, 0.070 inch, 0.075 inch, 0.080 inch, 0.085 inch 0.090 inch, 0.095 inch, 0.100 inch, 0.105 inch, 0.110 inch, or 0.115 inch. In many embodiments where the slit 1560 extends into a portion of the insert 1540, the width 1568 of the slit 1560 is equal to or slightly greater than the thickness 1524 of the divider 1522.

In some embodiments, the slit 1560 extends perpendicular to the rear surface 1542 of the insert 1540. In other embodiments, the slit 1560 can extend at an angle relative to the rear surface 1542 of the insert 1540. For example, the slit 1560 can extend up to 25 degrees toward or away from the front surface 1542 of the insert 1540. For example, the slit can be angled at 3, 6, 9, 12, 15, 18, 21, or 25 degrees toward or away from the front surface 1542 of the insert 1540.

The insert 1540 can further comprise an insert aperture 1570. The insert aperture 1570 extends through the top portion 1552 and the bottom portion 1562, wherein the insert aperture 1570 in the top portion 1552 is concentric with the insert aperture 1570 in the bottom portion 1562. In one embodiment, the insert aperture 1570 is positioned centrally or at a midpoint between the first end 1546 and the second end 1548, and between the front surface 1542 and the back surface 1544. In other embodiments, the insert aperture 1570 can be positioned toward the first end 1546, toward the second end 1548, toward the front surface 1542, or toward the back surface 1544.

As illustrated in FIG. 16, the insert 1540 can comprise one insert aperture 1570. In other embodiments, the insert 1540 can comprise at one, two, three, four, or five insert apertures 1570. In many embodiments, the number of insert apertures 1570 corresponds to the number of apertures 1528 of the divider 1522. The insert aperture 1570 corresponds in location to the position of the aperture 1528 of the divider 1522, wherein the insert aperture 1570 is concentric to the aperture 1528 of the divider 1522 when the insert 1540 is positioned within the cavity 1516.

The insert aperture 1570 can comprise a diameter 1572. According to one embodiment, the insert aperture 1570 can comprise a diameter of 0.150 inch. In other embodiments, the diameter 1572 of the insert aperture 1570 can range between 0.100 inch to 0.250 inch, 0.100 inch to 0.130 inch, 0.130 inch to 0.160 inch, 0.160 inch to 0.190 inch, 0.190 inch to 0.230 inch, or 0.230 inch to 0.250 inch. For example, the width 1530 of the insert aperture 1570 can be 0.100 inch, 0.125 inch, 0.150 inch, 0.175 inch, 0.200 inch, 0.225 inch, or 0.250 inch. In many embodiments, the diameter 1572 of the insert aperture 1570 is the same as the width 1530 of the aperture 1528 of the divider 1522.

The inert 1240 can further comprise a mass. The mass of the insert 1240 can range from 0.02 gram to 32 grams, 0.02 gram to 0.40 gram, 0.040 gram to 0.80 gram, 0.080 gram to 3 grams, 3 grams to 9 grams, 9 grams to 15 grams, 15 grams to 21 grams, 21 grams to 27 grams, 27 grams to 32 grams, 0.02 gram to 10 grams, 10 grams to 20 grams, or 20 grams to 32 grams. For example, the mass of the first component 242 can be 0.02 grams, 0.50 grams, 1 gram, 5 grams, 10 grams, 15 grams, 20 grams, 25 grams, 30 grams, or 32 grams.

In some embodiments, the top portion 1552 and the bottom portion 1562 of the insert 1540 can comprise the same mass. In other embodiments, the top portion 1552 can comprise less mass than the bottom portion 1562 of the insert 1540. For example, the top portion 1552 can comprise a mass ranging from 0.02 gram to 0.80 gram, 0.080 gram to 4 grams, 4 grams to 8 grams, 8 grams to 12 grams, or 12 grams to 15 grams (e.g., 0.02 grams, 0.50 grams, 1 gram, 5 grams, 10 grams, or 15 grams), while the front portion 1262 can comprise a mass ranging from 7 grams to 32 grams, 7 grams to 15 grams, 15 grams to 18 grams, 18 grams, to 23 grams, 23 grams to 28 grams, 28 grams to 32 grams (e.g., 7 grams, 15 grams, 20 grams, 25 grams, 30 grams, or 32 grams). In other embodiments, the top portion 1552 can comprise more mass than the bottom portion 1562 of the insert 1540. For example, the bottom portion 1562 can comprise a mass ranging from 0.02 gram to 0.80 gram, 0.080 gram to 4 grams, 4 grams to 8 grams, 8 grams to 12 grams, or 12 grams to 15 grams (e.g., 0.02 grams, 0.50 grams, 1 gram, 5 grams, 10 grams, or 15 grams), while the top portion 1552 can comprise a mass ranging from 7 grams to 32 grams, 7 grams to 15 grams, 15 grams to 18 grams, 18 grams, to 23 grams, 23 grams to 28 grams, 28 grams to 32 grams (e.g., 7 grams, 15 grams, 20 grams, 25 grams, 30 grams, or 32 grams).

The insert aperture 1570 can receive a fastener 1574. The fastener 1574 can comprise a self-threaded screw, a co-molded thread, screw, rivets (solid head rivets or blind rivets) or any other type of fastener. The fastener 1574 can be one fastener 1574, two fasteners 1574, three fasteners 1574, four fasteners 1574, or five fasteners 1574. In many embodiments, the number of fasteners 1574 corresponds with the number of insert apertures 1570. When the insert 1540 is positioned within the cavity 1516 of the golf club head 1500, the fastener 1574 is positioned through the insert aperture 1570 located on the top portion 1552 of the insert 1740, extends through the aperture 1528 of the divider 1522 and through the insert aperture 1570 in the bottom portion 1562 of the insert 1540.

When the fastener 1574 positioned within the insert aperture 1570, and the aperture 1528 of the divider 1522 helps secure and compress the insert 1540 against the divider 1522 of the cavity 1516. The compression of the insert 1540 against the divider 1222 creates a surface friction between the top inner surface 1556 of the top portion 1552 of the insert 1540 and the bottom inner surface 1566 of the bottom portion 1562 of the insert 1540 against the divider 1522. The combination of the fastener 1574 and surface friction prevents the insert 1540 from dislodging from the cavity 1516, thereby securing the insert 1540 within the cavity 1516.

In some embodiments, wherein the fastener 1274/1574 is a solid head rivet, a hammer or rivet gun are used to deform a shaft and head of the fastener 1274/1574 against the back outer surface 1254 (or top outer surface 1554) and front outer surface 1264 (or bottom outer surface 1564), which compress the insert 1240/1540 together with the divider 1222/1522. The compression of the insert 1240/1540 together with the divider 1222/1522 create a friction between the back inner surface 1256 (or top inner surface 1556) and the front inner surface 1266 (or bottom inner surface 1566) with the divider 1222/1522, securing the insert 1240/1540 within the cavity 1216/1516.

In other embodiments, the fastener 1274/1574 is a blind rivet (or "pop" rivet). The fastener 1274/1574 can comprise a hollow rivet body and a mandrel positioned within the hollow rivet body. At a base of the mandrel is a lip that extends along the circumference of the mandrel. The mandrel is pulled in a direction away from the insert 1240/1540, wherein the lip of the base of the mandrel compresses and flares a base of the hollow rivet body. The flare of the hollow body rivet secures the fastener 1274/1574 within the insert 1240/1540 and thus securing the insert 1240/1540 within the cavity 1216/1516.

In many embodiments, the insert 1540 can comprise a plastically deformable material. In some embodiments, the plastically deformable material of the insert 1540 can comprise metal, tungsten, aluminum, titanium, vanadium, chromium, cobalt, nickel, other metals, shim stock, steel, copper, metal alloy, plastic, or composite material. In various embodiments, insert 1540 can comprise an elastically deformable material or a shape memory metal or metal alloy, such as nickel titanium.

In some embodiments, the material of the bottom portion 1562 and the material of the top portion 1552 of the insert 1540 can be different from one another. In other embodiments, the material of the bottom portion 1562 and the material of the bottom portion 1552 can comprise the same material. In some embodiments, the material of the bottom portion 1562 and the material of the top portion 1552 can each be denser than a material of the golf club head 1500. In other embodiments, the material of the bottom portion 1562 and the material of the top portion 1552 can be the same density or less dense than the material density of the golf club head 1500.

D. Insert with Groove and Recesses

Figure 20:
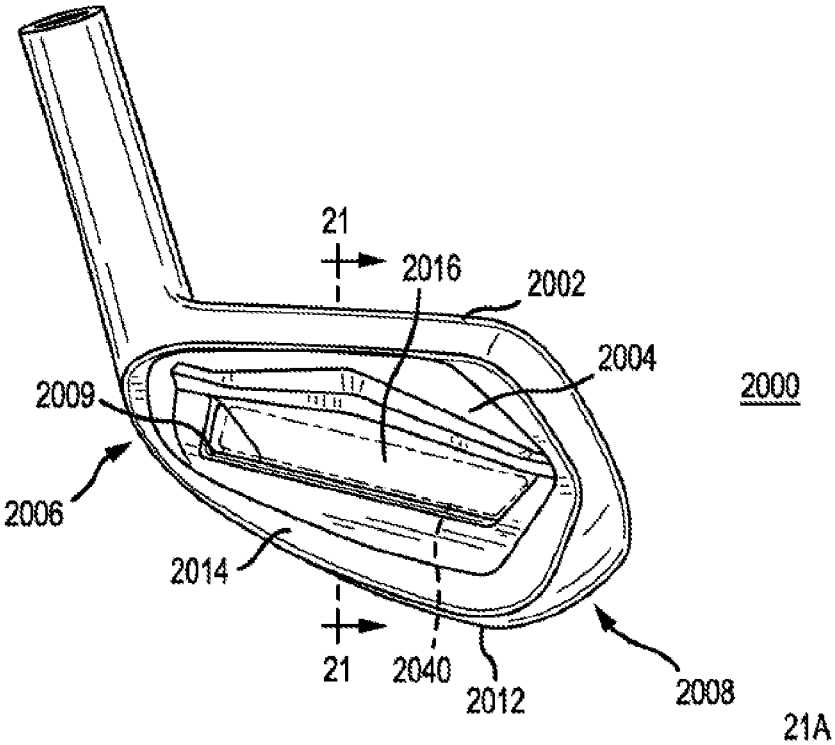
FIG. 20 depicts a back, toe-side perspective view of a golf club head according to another embodiment.

FIG. 20 illustrates a golf club head 2000, which can be similar to golf club head 100 of FIG. 1, 400 of FIG. 5, 700 of FIG. 8, 1200 of FIG. 12, and/or 1500 of FIG. 15. In some embodiments, the golf club head 2000 can be an iron-type golf club head. In other embodiments, the golf club head 2000 can be another type of golf club head (e.g., a driver-type club head, a fairway wood-type club head, a hybrid-type club head, a wood-type club head, a wedge-type club head, or a putter-type club head). In some embodiments, the golf club head 2000 can comprise a strikeface 2002, a backface 2004 opposite the strikeface 2002, a heel region 2006, a toe region 2008 opposite the heel region 2006, a sole 2012, and a rear portion 2014. The golf club head 2000 can further comprise a face side wall 2020, a rear side wall 2022 opposite the face side wall 2020, and a bottom wall 2024 positioned between the face side wall 2020 and the rear side wall 2022 forming a cavity 2016, wherein the cavity 2016 can be configured to receive an insert 2040. The face side wall 2020 of the cavity 2016 forms a portion of the backface 2004. In some embodiments, the golf club head 2000 can comprise a hosel, which in other embodiments can be omitted. In many embodiments, the rear portion 2014 can be designed to look similar to a traditional muscleback iron golf club head. For example, many muscleback irons have a full back or full rear portion of a golf club head. Muscleback irons differ from non-muscleback irons in which the rear or back of the golf club head has been hollowed out to at least partially remove the muscleback, full back and/or rear portion. In some embodiments, the rear portion 2014 can be designed to provide a heavy or thick look to the golf club head.

Figure 21:
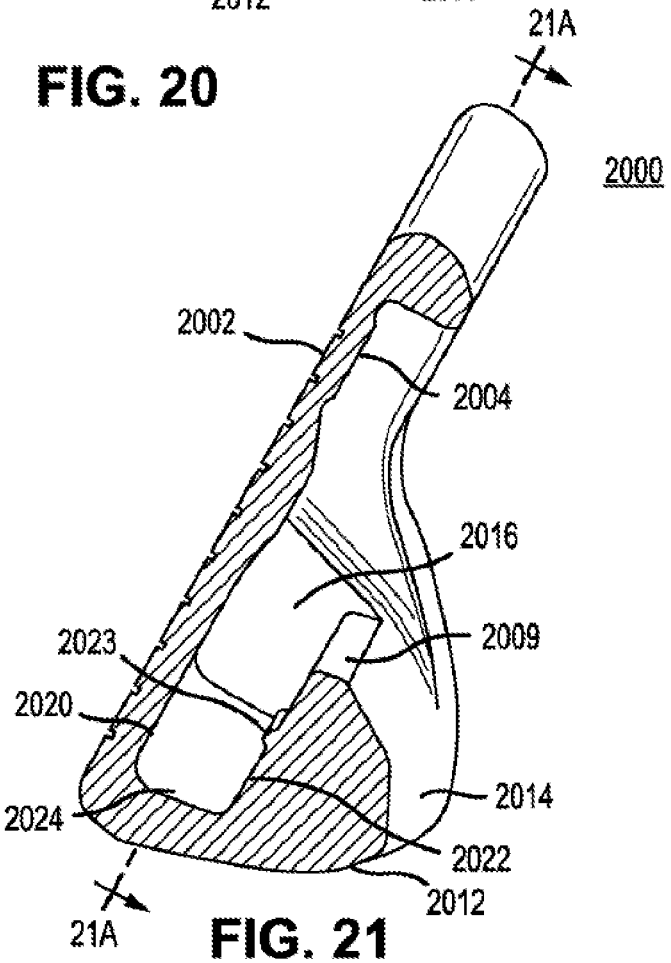
FIG. 21 depicts the golf club head of FIG. 20 along a cross-sectional line 21-21 in FIG. 20 without an insert.

Illustrated in FIG. 21 is a cross-sectional view of the golf club head 2000 of FIG. 20 at a cross-sectional line 21-21. The cavity 2016 as seen in FIG. 21, along cross-sectional line 21-21 of FIG. 20, can be similar to the cavity 116 (FIGS. 2 and 3) of the golf club head 100, the cavity 416 (FIG. 6) of golf club head 400, and the cavity 716 (FIG. 9) of golf club head 700. The face side wall 2020, the rear side wall 2022, and the bottom side wall 2024 together form the cavity 2016 in the rear portion 2014 of the club head 2000.

Figure 21A:
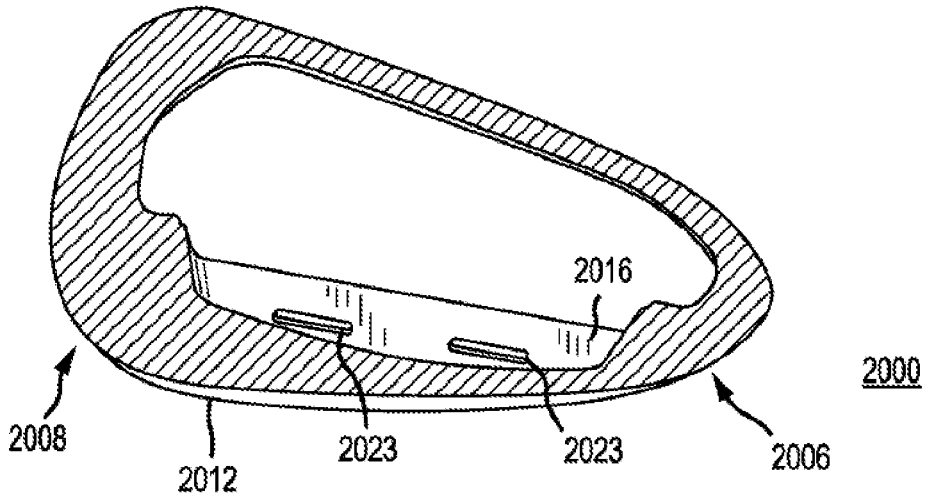
FIG. 21A depicts the golf club head of FIG. 21 along a cross-sectional line 21A-21A in FIG. 21 without an insert.

In many embodiments, the rear side wall 2022 of the cavity 2016 further comprises one or more protrusions 2023 extending into a portion of the cavity 2016, as illustrated in FIG. 21 and FIG. 21A. In some embodiments, the one or more protrusions 2023 can be positioned centrally on the rear side wall 2022. In other embodiments, the one or more protrusions 2023 can be positioned near the heel region 2006 or near the toe region 2008 of the rear side wall 2022 of the cavity 2016. In some embodiments, the rear side wall 2022 can comprise one, two, three, four, five, six, seven, eight, or nine protrusions 2023. In these embodiments, the one or more protrusions 2023 can be spaced equidistant from one another; while in other embodiments, the one or more protrusions 2023 can be spaced any distance from one another. In other embodiments, the one or more protrusions 2023 can form a square grid-like structure (not shown). For example, the one or more protrusions 2023 can form a two by two square grid, or a three by three square grid. In an exemplary embodiment, the one or more protrusions 2023 can comprise two protrusions extending into a portion of the cavity 2016 that are spaced equidistant from one another.

Figure 22:
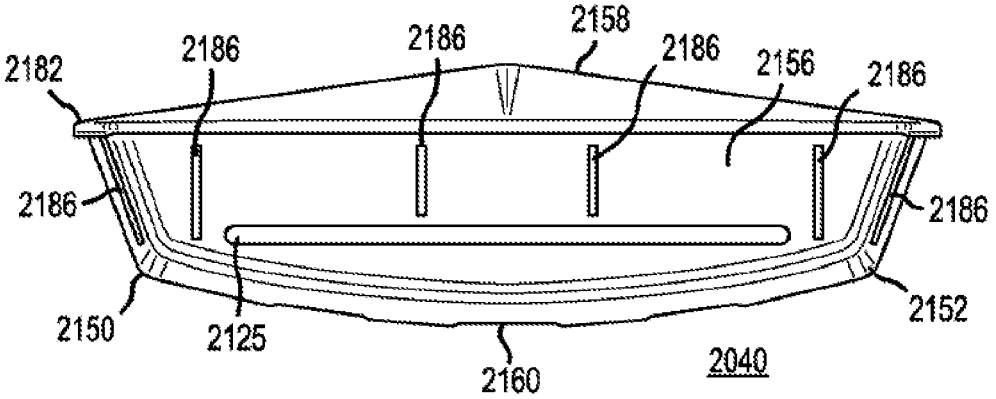
FIG. 22 depicts a back perspective view of an insert of the golf club head of FIG. 20, according to an embodiment.
Figure 23:
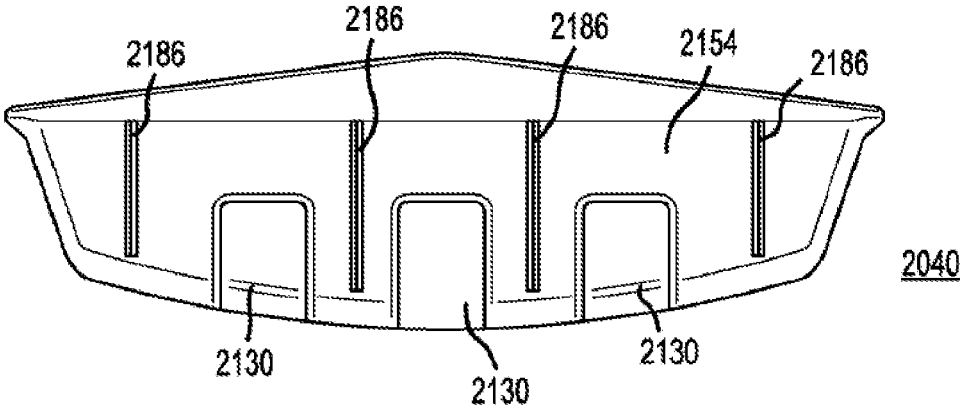
FIG. 23 depicts a front perspective view of an insert of the golf club head of FIG. 20, according to an embodiment.

FIG. 22 and FIG. 23 illustrate the insert 2040. The insert 2040 can comprise a first end 2150 proximate the heel region 2006 of the golf club head 2000, a second end 2152 proximate the toe region 2008 of the golf club head 2000, a back surface 2156, a front surface 2154 opposite the back surface 2156, a top surface 2158, and a bottom surface 2160 opposite the top surface 2158.

The insert 2040 can further comprise a lip 2182. In many embodiments, the lip 2182 can protrude from the top surface 2158 of the insert 2040. Further, the lip 2182 can extend perpendicular to the back surface 2156 of the insert 2040. In many embodiments, the lip 2182 can extend along a portion of the insert 2040 in a direction from the first end 2150 to the second end 2152. For example, the lip 2182 can extend along the back surface 2156, from the first end 2150 to the second end 2152 of the insert 2040. In other embodiments, the lip 2182 can extend along the front surface 2154 from the first end 2150 to the second end 2152. In other embodiments, the lip can extend along at least a portion of the front surface 2154, the back surface 2156, or any combination thereof. Further, in other embodiments, the lip can be continuous or discontinuous. When the insert 2040 is positioned within the cavity 2016, the lip 2182 of the top surface 2158 abuts against a top surface 2009 of the rear portion 2014. The lip 2182 of the top surface 2158 can act as a lever to remove the insert 2040 from the cavity 2016 during fittings or adjustments.

As illustrated in FIG. 22, the insert 2040 can comprise one or more grooves 2125 positioned centrally on the back surface 2156 of the insert 2040. In some embodiments, the one or more grooves 2125 can extend into a portion of the back surface 2156 of the insert 2040. In other embodiments, the one or more grooves 2125 can extend all the way through the insert 2040 from the back surface 2156 to the front surface 2154. The one or more grooves 2125 can extend in the direction of the first end 2150 to the second end 2152 of the insert 2040. The one or more grooves 2125 can be continuous or segmented from the first end 2150 to the second end 2152 of the insert 2040. The one or more grooves 2125 can comprise a first end proximate the first end 2150 of the insert 2040 and a second end proximate the second end 2152 of the insert 2040. The first end 2150 and the second end 2152 of the one or more grooves 2125 can comprise a rounded shape. In other embodiments, the first end 2150 and the second end 2152 of the one or more grooves 2125 can comprise any shape such as a square shape, a triangular shape, a trapezoidal shape, a polygonal shape, or any other suitable shape. In some embodiments, the insert 2040 can comprise one, two, three, four, five, six, seven, eight, or nine grooves 2125. The one or more grooves 2125 can be similar to the square grid-like structure of the one or more protrusions 2023 as described above. In an exemplary embodiment, the one or more grooves 2125 can comprise one continuous groove 2125 extending from the first end 2150 to the second end 2152 of the insert 2040.

As illustrated by way of example in FIG. 23, the insert 2040 can further comprise one or more recesses 2130 on the front surface 2154 of the insert 2040. In some embodiments, the one or more recesses 2130 can be positioned centrally on the front surface 2154 in between the first end 2150 and the second end 2152 of the insert 2040. In other embodiments, the one or more recesses 2130 can be positioned near the first end 2150 or near the second end 2152 of the insert 2040. In some embodiments, the insert 2040 can comprise one, two, three, four, five, or six recesses 2130. In these embodiments, the one or more recesses 2130 can be spaced equidistant from one another; while in other embodiments, the one or more recesses 2130 can be spaced any distance from one another. In these embodiments, the one or more recesses 2130 allows for a greater flow of an adhesive into the cavity 2016 and more adhesive to be positioned between the cavity 2016 and the insert 2040. In an exemplary embodiment, the one or more recesses 2130 can comprise three recesses positioned centrally on the front surface 2154 of the insert 2040 that are spaced equidistant from one another.

The insert 2040 can further comprise one or more ribs 2186. The one or more ribs 2186 can be positioned on the back surface 2156 of the insert 2040. In other embodiments, the one or more ribs 2186 can be positioned on a front surface 2154 of the insert 2040, or on a combination of the back surface 2156, the first end 2150, the second end 2152, and the front surface 2154 of the insert 2040. In some embodiments, the one or more ribs 2186 can be positioned near the first end 2150 or near the second end 2152 on the insert 2040. Furthermore, the one or more ribs 2186 can be orientated perpendicular (straight up and down) relative to the top surface 2158 of the insert 2040. In other embodiments, the one or more ribs 2186 can be orientated at various angles relative to top surface 2158. In some embodiments, the insert 2040 can comprise one, two, three, four, five, six, seven, eight, nine, ten, eleven, or twelve ribs 2186. In some embodiments, the one or more ribs 2186 are oriented in the same direction. In other embodiments, the one or more ribs 2186 are oriented in different directions than the other one or more ribs 2186. In embodiments with more than one rib 2186, the ribs 2186 can be spaced equidistant from one another, or spaced any distance from one another. In some embodiments, an adhesive is applied within the cavity 2016 to help secure the insert 2040. The combination of the adhesive and the one or more ribs 2186 prevents the insert 2040 from shifting within the cavity 2016. In many embodiments, the one or more ribs 2186 allow for the insert 2040 to compress as it is being positioned within the cavity 2040.

Figure 24:
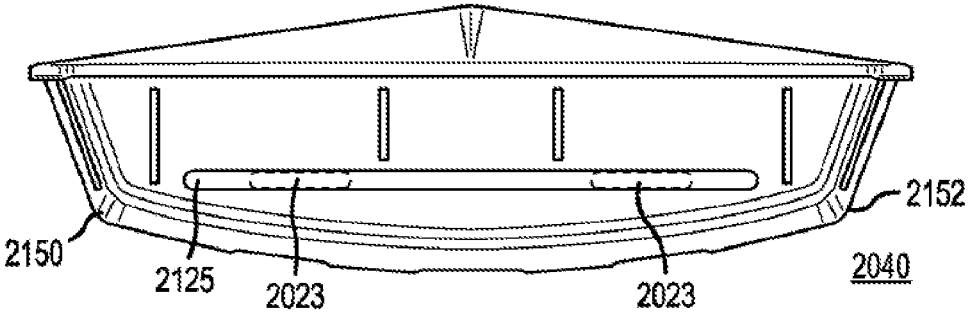
FIG. 24 depicts a back perspective view of an insert of the golf club head of FIG. 20, according to an embodiment.

When the cavity 2016 of the golf club head 2000 receives the insert 2040, the front surface 2154 of the insert 2040 presses against or abuts the face side wall 2020 of the cavity 2016, the back surface 2156 of the insert 2040 presses against or abuts the rear side wall 2022 of the cavity 2016, the bottom surface 2160 of the insert 2040 presses against or abuts with the bottom wall 2024 of the cavity 2016, and the top surface 2158 of the insert 2040 forms a portion of the rear portion 2014 of the golf club head 2000. As illustrated in FIG. 24, the one or more protrusions 2023 of the rear side wall 2022 are received by the one or more grooves 2125 of the insert 2040 to secure the insert 2040 into the cavity 2016. The one or more protrusions 2023 of the rear side wall 2022 and the one or more grooves 2125 of the insert 2040 have complementary geometries to allow for a mechanical interlock. In addition to the mechanical interlock between the one or more protrusions 2023 and the one or more grooves 2125, the insert 2040 can be secured within the cavity 2016 with a press-fit, a friction fit, an adhesive, or any combination thereof. In some embodiments, the insert 2040 can be secured within the cavity 2016 without the use of threads. The structural interlock between the one or more protrusions 2023 and the one or more grooves 2125 secures the insert into the cavity 2016, lowering the likelihood of the insert 2040 dislodging during use.

In many embodiments, the insert 2040 can comprise a mass. The mass of the insert 2040 can range from 0.50 to 36 grams, 0.50 to 30 grams, 0.50 to 25 grams, 0.50 to 20 grams, 0.50 to 15 grams, 0.50 to 10 grams, or 0.50 to 5 grams. For example, the mass of the insert 2040 can be 0.50 gram, 1 gram, 2 grams, 3 grams, 5 grams, 10 grams, 15 grams, 20 grams, 25 grams, 30 grams, or 36 grams.

In some embodiments, the insert 2040 can comprise a material denser than a material of the body of the golf club head 2000. In other embodiments, the material of insert 2040 can be the same density or less dense than the material of body of the golf club head 2000. In a number of embodiments, the material of insert 2040 can comprise an elastically deformable material and can be similar to the first component 242 (FIG. 4A) of the insert 140, or the first component 542 (FIG. 7A) of the insert 440. In many embodiments, the elastically deformable material of the insert can comprise a polymer, a urethane material, a urethane-based material, an elastomer material, a thermoplastic material, other suitable types of material, a composite, or a combination thereof. In some embodiments, the material of the insert 2040 can comprise a thermoplastic elastomer, thermoplastic polyurethane, resin, or resin mixed with powdered metals. In some embodiments, the resin can comprise a thermoplastic elastomer, or thermoplastic polyurethane.

In embodiments where the insert 2040 comprises a resin mixed with powdered metals, the resin can comprise a mass. The mass of the resin can range from 0.5 grams to 8 grams. In some embodiments, the mass of the resin can range from 0.5 grams to 4 grams, or 4 grams to 8 grams. For example, the mass of the resin can be 0.5 gram, 1 gram, 2 grams, 3 grams, 4 grams, 5 grams, 6 grams, 7 grams, or 8 grams. The resin comprises a specific gravity ranging from 0.5 gm/cc to 8 gm/cc. In some embodiments, the specific gravity can range from 0.5 gm/cc to 4 gm/cc, or 4 gm/cc to 8 gm/cc. For example, the specific gravity of the resin can be 0.5 gm/cc, 1 gm/cc, 2 gm/cc, 3 gm/cc, 4 gm/cc, 5 gm/cc, 6 gm/cc, 7 gm/cc, or 8 gm/cc. In some embodiments, the specific gravity of the resin is proportional to the mass of the resin, wherein 1 specific gravity of the resin is equal to 1 gram, 2 specific gravity of the resin is equal to 2 grams and etc.

In these embodiments, the powdered metal can comprise steel, stainless steel, tungsten, or other metals. In these embodiments, the resin mixed with powdered metals forms the insert 2040 described above. In some embodiments, the insert 2040 can comprise one powdered metal. In other embodiments, the insert 2040 can comprise multiple types of powdered metals. For example, the insert 2040 can comprise the resin and the stainless steel powdered metal, the resin and the tungsten powdered metal, or the resin, the stainless steel powdered metal, and the tungsten powdered metal. The insert 2040 can further comprise a percentage of powdered metal by volume. The insert 2040 can comprise 0% to 50% powdered metal by volume. In some embodiments, the insert 2040 can comprise 0% to 10%, 10% to 20%, 20% to 30%, 30% to 40%, or 40% to 50% powdered metal by volume. For example, the insert 2040 can comprise 0%, 1%, 10%, 20%, 30%, 40%, or 50% powdered metal by volume. The powdered metal percentage varies approximately linearly with the mass of the insert 2040. As the mass of the insert 2040 increases, the powdered metal percentage increases.

In many embodiments, the material of the insert 2040 can dampen vibrations on the golf club head 2000 after impact of a golf ball on the strikeface 2002, which can improve feel and sound. In many embodiments, the hardness of the insert 2040 can range from Shore A 10 to Shore A 55. In some embodiments, the hardness of the insert 2040 can range from Shore A 10 to Shore A 25, Shore A 15 to Shore A 25, Shore A 20 to Shore A 30, Shore A 25 to Shore A 35, Shore A 25 to Shore A 40, or Shore A 40 to Shore A 55. For example, the hardness of the insert 2040 can have a Shore A value of 10, 15, 25, 30, 35, 40, 45, 50, or 50.

In many embodiments, the strikeface 2002 can comprise a thickness. The thickness of the strikeface 2002 can be measured in the direction perpendicular from the strikeface 2002 to the backface 2004 of the golf club head 2000. The thickness of the strikeface 2002 can range from 0.05 to 0.20 inch. In some embodiments, the thickness of the strikeface 2002 can range from 0.05 to 0.18 inch, 0.05 to 0.16 inch, 0.05 to 0.14 inch, 0.05 to 0.12, or 0.05 to 0.10 inch. For example, the thickness of the strikeface 2002 can be 0.05, 0.06, 0.07, 0.08, 0.09, 0.10, 0.11, 0.12, 0.13, 0.14 0.15, 0.16, 0.17, 0.18, 0.19, or 0.20 inch.

In many embodiments, the strikeface 2002 of the club head 2000 includes a surface area. In the illustrated embodiment, the surface area of the strikeface 2002 can from 4.0 $in^2$ to 6 $in^2$. In some embodiments, the surface area of the strikeface 2002 can range from 4.0 $in^2$ to 5.0 $in^2$, or 5.0 $in^2$ to 6.0 $in^2$. For example, the surface area of the strikeface 2002 can be 4.0 $in^2$, 4.4 $in^2$, 4.8 $in^2$, 5.2 $in^2$, 5.6 $in^2$, or 6.0 $in^2$.

In many embodiments, when the insert 2040 is positioned within the cavity 2016 of the club head 2000, the insert 2040 has increased contact area with the backface 2004 compared to current designs. The contact area of insert 2040 with back face 2004 can range from 1.0 $in^2$ to 3.0 $in^2$. In some embodiments, the contact area of insert 2040 with backface 2004 can range from 1.0 $in^2$ to 2.0 $in^2$, or 2.0 $in^2$ to 3.0 $in^2$. For example, the contact area of insert 2040 with backface 2004 can be 1.0 $in^2$, 1.5 $in^2$, 2.0 $in^2$, 2.5 $in^2$, or 3.0 $in^2$. In many embodiments, the contact area of insert 2040 with backface 2004 can range from 15% to 35% of the surface area of strikeface 2002. In some embodiments, the contact area of the insert 2040 with backface 2002 can range from 15% to 20%, 20% to 25%, 25% to 30%, or 30% to 35% of the surface area of strikeface 2002. For example, the contact area of insert 2040 with backface 2002 can be 15%, 16%, 17%, 18%, 19%, 20%, 21%, 22%, 23%, 24%, 25%, 26%, 27%, 28%, 29%, 30%, 31%, 32%, 33%, 34%, or 35% of the surface area of strikeface 2002.

The insert 2040 can comprise a lower hardness compared to other golf club heads with inserts provided within the cavity. The lower hardness provides less support on the backface 2002 and maximizes the strikeface deflection after impacts of the golf ball. Further, the increased contact area between the insert 2040 and the backface 2002 provides more support to the backface 2002 during impacts of the golf ball to offset the structural support losses from the lower hardness of the insert 2040. The increased contact area allows portions of the strikeface 2002 to be thinned, thereby reducing the club head weight, while maintaining durability. The combination of the lower hardness, the increased contact area between the insert 2040 and the backface 2002, and the thinned strikeface 2002 provides more strikeface deflection over other golf club head with inserts provided within the cavity. In these embodiments, the strikeface deflection can range from 0.012 inch to 0.020 inch. In some embodiments, the strikeface deflection can range from 0.012 inch to 0.016 inch, or 0.016 inch to 0.020 inch. For example, the strikeface deflection can be 0.012 inch, 0.013 inch, 0.014 inch, 0.015 inch, 0.016 inch, 0.017 inch, 0.018 inch, 0.019 inch, or 0.020 inch.

Figure 25:
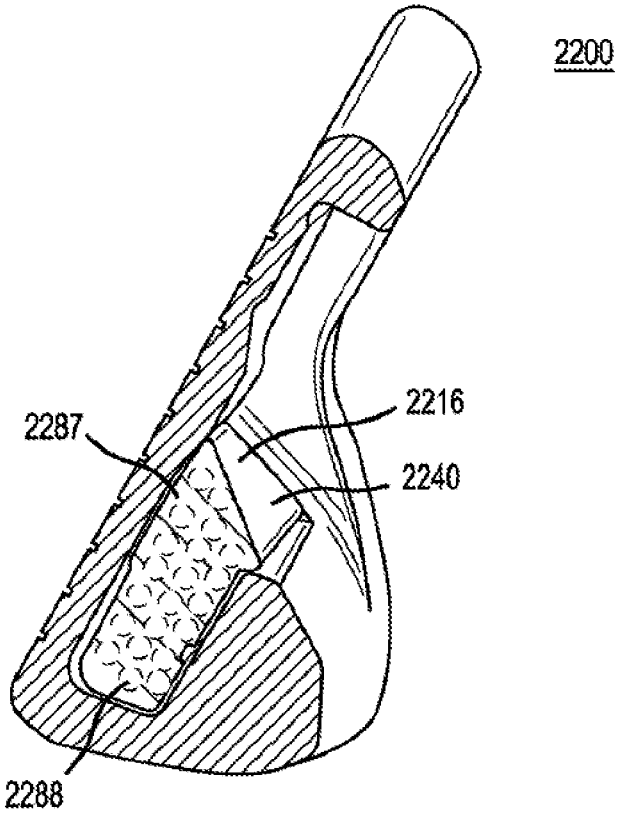
FIG. 25 depicts a toe-side cross-sectional view of a golf club head and insert, according to another embodiment.

Another embodiment, an example of which is illustrated in FIG. 25, includes a golf club head 2200 that can be similar to the golf club head 100 of FIG. 1, the golf club head 400 of FIG. 5, the golf club head 700 of FIG. 8, the golf club head 1200 of FIG. 12, the golf club head 1500 of FIG. 15, and/or the golf club head 2000 of FIG. 20. The golf club head 2200 can comprise a cavity 2216. The cavity 2216 is configured to receive an insert 2240 having a first component 2287 comprising a first material and a second component 2288 comprising a second material. The first material of the first component 2287 can comprise a polymer material, a urethane material, a urethane-based material, an elastomer material, a thermoplastic material, a composite, other suitable types of materials, or a combination thereof. The second material of the second component 2288 can comprise metal formed within the first component 2287. In some embodiments, the second component 2288 can comprise a plurality of spherical metal beads (e.g. BB's). In other embodiments, the second component 2288 can comprise one or more metallic objects comprising any shape (e.g. square, triangle, polygon, etc.). The one or more metallic objects can be shavings, flakes, rods, tubes, or any other suitable metallic object. The second component 2288 can increase the overall weight of the insert 2240. The second material that forms the second component 2288 can comprise metals such as steel, tungsten, aluminum, titanium, vanadium, chromium, cobalt, nickel, other metals, metal alloys, plastics, composites, or any combination thereof. In one example, the second component 2288 of the insert 2240 can comprise spherical tungsten beads suspended within the first component 2287 comprising the thermoplastic material. In many embodiments, the second component 2288 is set within the first component 2287 of the insert 2240. The second component 2288 can be positioned within the first component 2287 in any desirable location. For example, the second component 2288 can be positioned near the heel region, the toe region, or a combination of the heel region and toe region of the golf club head. The second component 2288 adds weight to the golf club head 2200 and therefore adjust the swing weighting of the golf club head 2200 to affect center of gravity (CG) and moment of insert (MOI), to improve feel and ball trajectory.

In some embodiments, the second component 2288 is suspended or embedded within the first component 2287 of the insert 2240, such that the first component 2287 fully surrounds the second component 2288. In other embodiments, the first component 2287 partially surrounds the second component 2288 such that the second component 2288 is exposed within the cavity 2216. The second component 2288 can comprise a diameter ranging from 0.5 mm (0.0197 inch) to 10 mm (0.394 inch). For example, the second component 2288 can have a diameter of 0.5 mm (0.0197 inch) to 1 mm (0.0394 inch), 1 mm (0.0394 inch) to 2 mm (0.0787 inch), 1 mm (0.0394 inch) to 4 mm (0.1575 inch), 2 mm (0.0787 inch) to 3 mm (0.1181 inch), 3 mm (0.1181 inch) to 4 mm (0.1575 inch), 4 mm (0.1575 inch) to 5 mm (0.1969 inch), 5 mm (0.1969 inch) to 6 mm (0.2362 inch), 6 mm (0.2362 inch) to 7 mm (0.2756 inch), 7 mm (0.2756 inch) to 8 mm (0.315 inch), 8 mm (0.315 inch) to 9 mm (0.3543 inch), or 9 mm (0.3543 inch) to 10 mm (0.394 inch). The insert 2240 can comprise between approximately 1 and 100 second components 2288. The number of second components 2288 included in the insert 2240 is partially dependent on the diameter of the individual second components 2288. In some embodiments, the insert 2240 comprises between 1 to 3, between 1 to 5, between 5 to 10, between 10 to 30, between 30 to 50, or between 50 to 100 second components 2288. The size and number of second components 2288 can affect the weight and vibration properties of the insert 2240, which can modify the CG, MOI, and feel of the golf club head 2200. The golf club head 2200 and its insert 2240 can further comprise any of the structural elements described above in reference to the golf club head 100 of FIG. 1, the golf club head 400 of FIG. 5, the golf club head 700 of FIG. 8, the golf club head 1200 of FIG. 12, the golf club head 1500 of FIG. 15, and/or the golf club head 2000 of FIG. 20.

In another embodiment not illustrated, a golf club head can comprise a cavity, wherein the cavity is configured to receive an insert. The golf club head can be similar to the golf club head 100 of FIG. 1, the golf club head 400 of FIG. 5, the golf club head 700 of FIG. 8, the golf club head 1200 of FIG. 12, the golf club head 1500 of FIG. 15, the golf club head 2000 of FIG. 20, and/or the golf club head 2200 of FIG. 25. The insert can comprise a metallic material such as steel, tungsten, aluminum, titanium, vanadium, chromium, cobalt, nickel, other metals, metal alloys, cerrocast alloy, or any combination thereof. The metallic material of the insert can be melted and applied (i.e., poured or injected) directly into the cavity of the golf club head. As the metallic material of the insert solidifies, the insert adheres to the surfaces of the cavity. The metallic material of the insert can be applied to the cavity at a specific weight, wherein the melted insert can be added in increments of 0.1 gram, or 0.5 grams. The metallic material of the insert can add weight into the golf club head and therefore adjust the swing weighting of the golf club head to affect center of gravity (CG), and moment of insert (MOI) to improve feel and ball trajectory. Directly applying the metallic material of the insert into the cavity of the club head can improve product quality by reducing the likelihood of the insert falling out of the cavity during play.

Figure 18:
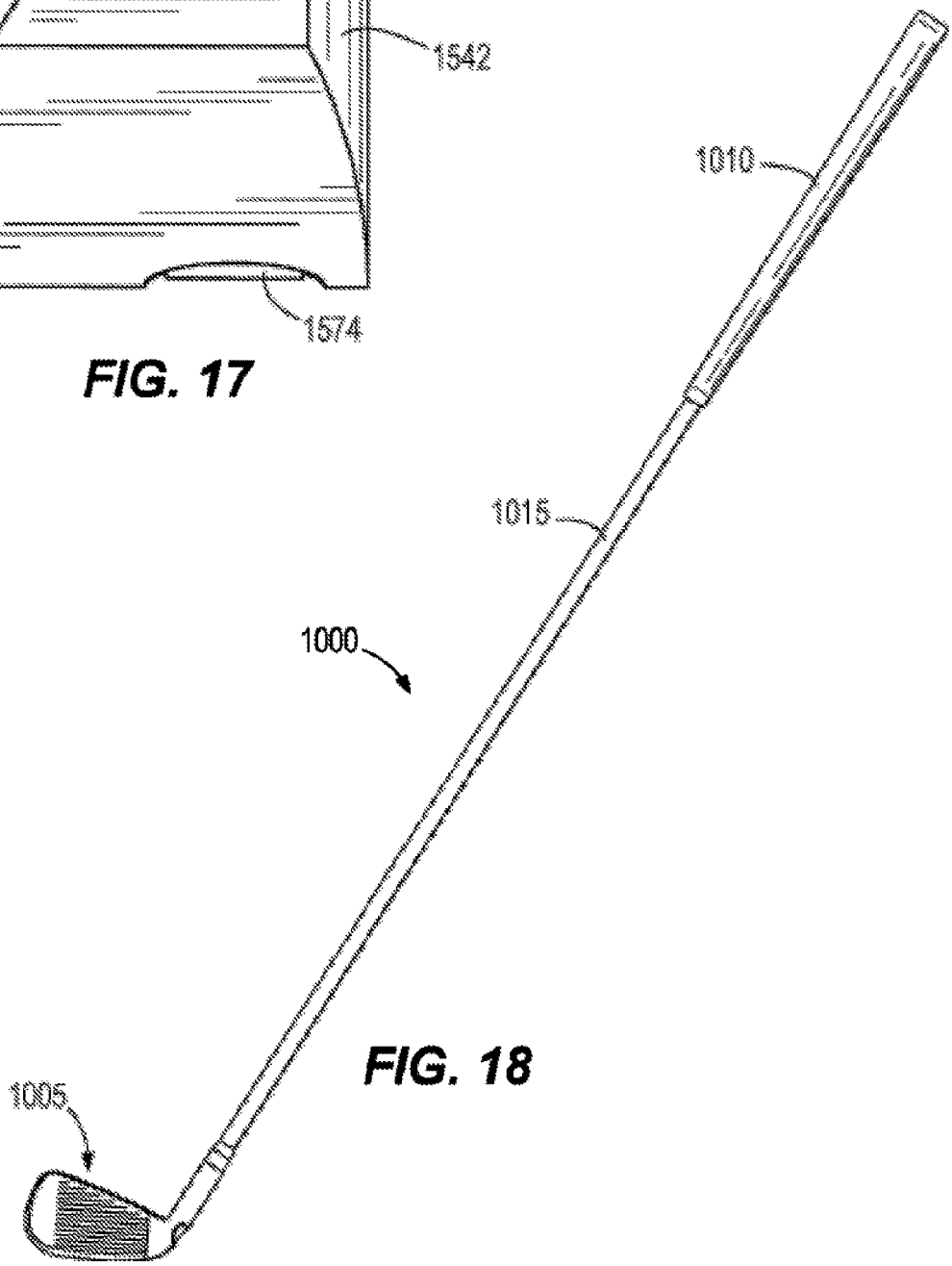
FIG. 18 depicts a front view of a golf club, according to an embodiment.

Some embodiments include a fully assembled golf club, such as a golf club 1000 as shown in FIG. 18. FIG. 18 shows a front view of a golf club 1000 according to an embodiment. In some embodiments, golf club 1000 can comprise a shaft 1015, a grip 1010 at one end of shaft 1015, and a golf club head 1005 connected to shaft 1015 at an opposite end of shaft 1015. In many embodiments, golf club head 1005 can be similar to golf club head 100 (FIG. 1), golf club head 400 (FIG. 4), golf club head 700 (FIG. 7), golf club head 1200 (FIG. 12), and/or golf club head 1500 (FIG. 15). In some embodiments, golf club 1000 is an iron-type golf club. In other embodiments, golf club 1000 can be another type of golf club head (e.g., a driver-type club head, a fairway wood-type club head, a hybrid-type club head, a wood-type club head, a wedge-type club head, or a putter-type club head).

Figure 19:
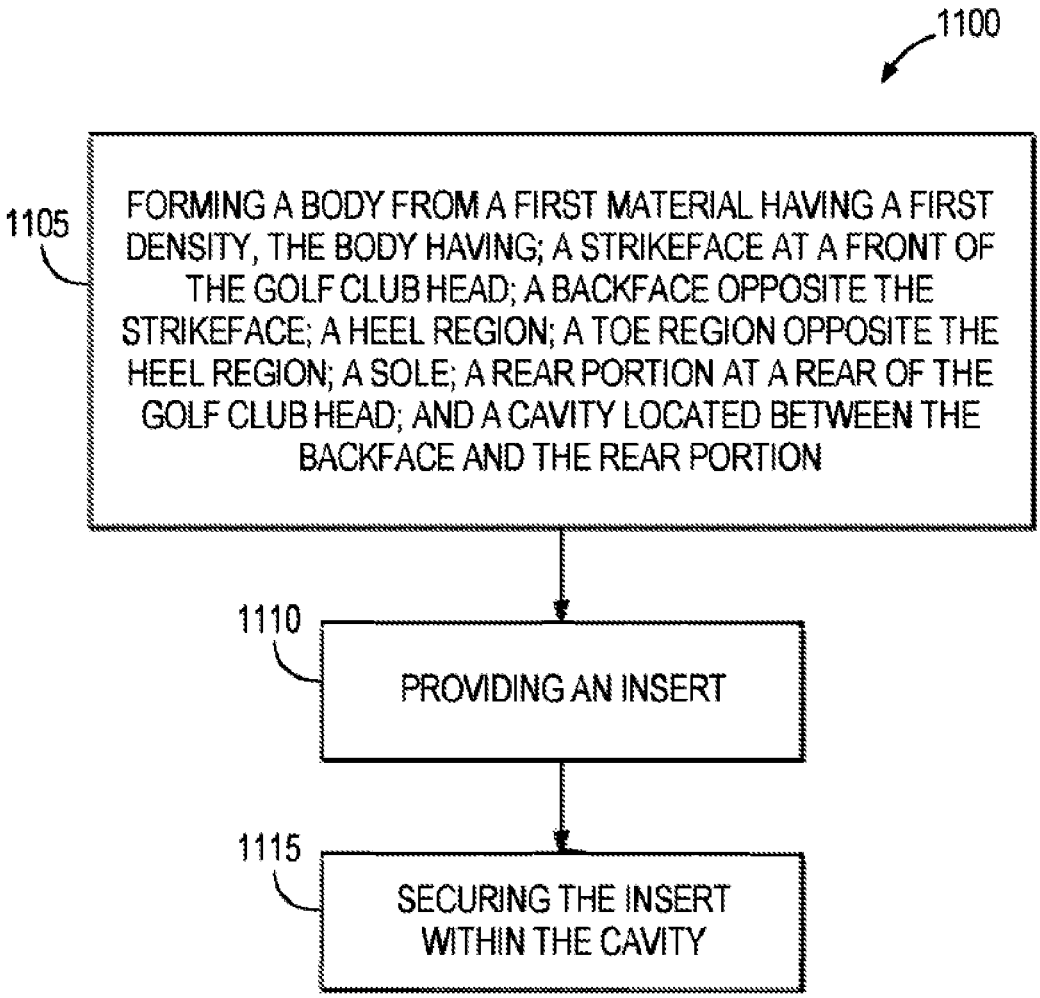
FIG. 19 depicts a method of manufacturing a golf club head according to an embodiment of a method.

Various embodiments include a method 1100 for manufacturing a golf club head, as shown in FIG. 19. FIG. 19 depicts a method of manufacturing a golf club head according to an embodiment. In some embodiments, method 1100 can be used to manufacture a golf club head similar to golf club head 100 (FIG. 1), golf club head 400 (FIG. 5), golf club head 700 (FIG. 7), golf club head 1200 (FIG. 12), golf club head 1500, and/or golf club head 1005 (FIG. 15).

In many embodiments, method 1100 can comprise forming a body from a first material having a first density (block 1105). In many embodiments, the body can comprise a strikeface at a front of the golf club head, a backface opposite the strike face, a heel region, a toe region opposite the heel region, a sole, a rear portion at a rear of the golf club head, and a cavity located between the backface and the rear portion. In some embodiments, forming a body from a first material can comprise forging the body. In other embodiments, forming a body from a first material can comprise casting the body. In other embodiments, forming a body from a first material can comprise molding the body. In some embodiments, method 1100 can comprise manufacturing a golf club head for an iron-type club head.

In many embodiments, method 1100 can further comprise providing an insert (block 1110) and securing the insert within the cavity (block 1115). In many embodiments, the insert can be similar to insert 140, insert 440, insert 740, insert 1240, and/or insert 1540. In some embodiments, securing the insert within the cavity (block 1115) can comprise securing the insert by a second component of the insert being in contact with a portion of the cavity (e.g., second material 244 against cavity 116). In some embodiments, securing the insert within the cavity (block 1115) can comprise inserting an edge of the second component of the insert within a slot in a portion of a wall of the cavity. In a number of embodiments, securing the insert within the cavity (block 1115) can comprise a portion of the insert being in contact with a post within the cavity (e.g., post 519). In many embodiments, the contact point(s) of the insert with the portions of the cavity can provide tension and/or friction to secure the insert in the cavity. In some embodiments, an adhesive can be used to assist in securing the insert in the cavity, but in other embodiments, no adhesive is used to secure or assist in securing the insert in the cavity. In other embodiments, the use of fasteners such as screws or rivets can assist in securing the insert within the cavity.

In some embodiments, the insert can comprise one or more flex slots at a bottom of the insert (e.g., flex slot 880). In many embodiments, the insert can exert a force on a toe-side wall of the cavity and a heel-side wall of the cavity. In some embodiments, the one or more flex slots can allow the insert to bend prior to being inserted or placement within the cavity, such that, when the insert is positioned within the cavity, the insert can return to its original shape and exert a force on the toe-side wall of the cavity and on the heel-side wall of the cavity in order to secure the insert within the cavity. In some embodiments, the one or more flex slots can be cut such that the insert can exert pressure against the backface-side wall of the cavity and the rear portion-side wall of the cavity. In a number of embodiments, the one or more flex slots can be cut at a diagonal relative to a length of the insert, and the insert can be twisted before placement within the cavity. In some embodiments, an adhesive can be used to assist in securing the insert in the cavity. In some embodiments, no adhesive is used to secure or assist in securing the insert in the cavity, but in other embodiments, an adhesive can fill a portion of the one or more flex slots in order to prevent flexing or loosening of the insert from the cavity after the adhesive is cured within the cavity.

The golf club heads with cavities and inserts and related methods discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment of systems and methods for fitting golf club head weight, and may disclose alternative embodiments of golf club heads with cavities and related methods.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Clause 1. A golf club head comprising: a body comprising: a strikeface at a front of the golf club head; a backface opposite the strikeface; a heel region; a toe region opposite the heel region; a sole; a rear portion at a rear of the golf club head; and a cavity located between the backface and the rear portion, the cavity comprising: a face side wall comprising a portion of the backface; a rear side wall opposite the face side wall, the rear side wall comprising a recess extending from the heel region to the toe region; a bottom wall between the face side wall and the rear side wall; and a width measured from the face side wall to the rear side wall; and an insert received within the cavity; wherein: the insert comprises: a first component comprising a back surface configured to be adjacent to the rear side wall of the golf club head, a front surface opposite the back surface, a bottom surface, a top surface opposite the bottom surface, a toe-region side, a heel region side opposite the toe-region side, and an elastically deformable material; and a retainer comprising a top surface, a bottom surface and a plastically deformable material, the retainer is configured to be removably received within the first component of the insert without the use of threads.

Clause 2. The golf club head of clause 1, wherein the first component of the insert comprises one or more slots extending from the front surface to the back surface, and the one or more slots are configured to receive the retainer.

Clause 3. The golf club head of clause 2, wherein one or more slots are positioned on the front surface and the back surface of the first component.

Clause 4. The golf club head of clause 1, wherein the retainer comprises a first edge having one or more tabs, and a second edge opposite the first edge, the second edge having one or more arms to be received within the recess of the rear side wall.

Clause 5. The golf club head of clause 4, wherein the one or more tabs abut the face side wall of the cavity and the one or more arms abut the rear side wall of the cavity, such that the retainer forms a U-shape curve when the insert is positioned in the cavity.

Clause 6. The golf club head of clause 1, wherein the retainer of the insert comprises a width greater than the width of the cavity and a width of the first component of the insert.

Clause 7. The golf club head of clause 1, wherein the insert comprises a mass ranging from 0.5 gram to 36 grams.

Clause 8. A golf club head comprising: a body comprising: a strikeface at a front of the golf club head; a backface opposite the strikeface; a heel region; a toe region opposite the heel region; a sole; a rear portion at a rear of the golf club head; and a cavity located between the backface and the rear portion, the cavity comprising: a face side wall comprising a portion of the backface; a rear side wall opposite the face side wall, the rear side wall comprising one or more protrusions extending into a portion of the cavity; a bottom wall between the face side wall and the rear side wall; and an insert received within the cavity; wherein: the insert comprises: a back surface positioned to be adjacent to the rear side wall of the golf club head, the back surface of the insert comprising one or more grooves configured to receive the one or more protrusions on the rear side wall of the cavity; a front surface opposite the back surface positioned to be adjacent to the face side wall of the golf club head; a bottom surface; a top surface opposite the bottom surface; and a elastically deformable material; and the insert comprises a hardness between approximately Shore A 10 to approximately Shore A 55.

Clause 9. The golf club head of clause 8, wherein the one or more grooves extend into a portion of the back surface of the insert.

Clause 10. The golf club head of clause 8, wherein the insert comprises a hardness between approximately Shore A 25 to approximately Shore A 35.

Clause 11. The golf club head of clause 8, wherein the insert comprises a mass ranging from 0.5 gram to 36 grams.

Clause 12. The golf club head of clause 8, wherein the strikeface comprises a thickness ranging from 0.05 inch to 0.20 inch.

Clause 13. The golf club head of clause 8, wherein a contact area of the insert with the backface comprises 15% to 35% of a surface area of the strikeface.

Clause 14. The golf club head of clause 8, wherein the elastically deformable material of the insert comprises a resin mixed with a powdered metal.

Clause 15. The golf club head of clause 14, wherein the insert comprises 1% to 30% powdered metal by volume.

Clause 16. The golf club head of clause 14, wherein the resin comprises a thermoplastic elastomer, or a thermoplastic polyurethane.

Clause 17. The golf club head of clause 14, wherein the powdered metal comprises stainless steel.

Clause 18. The golf club head of clause 14, wherein the powdered metal comprises tungsten.

Clause 19. The golf club head of clause 8, wherein the insert comprises a first component comprising a first material and a second component comprising a second material, where the second component is embedded within the first component.

Clause 20. The golf club head of clause 19, wherein the first material comprises a thermoplastic elastomer and the second material comprises spherical tungsten beads.

What is claimed is:

1. A golf club head comprising:

a body comprising:

a strikeface at a front of the golf club head;

a backface opposite the strikeface;

a heel-region;

a toe-region opposite the heel-region;

a sole;

a rear portion at a rear of the golf club head; and a cavity located between the backface and the rear portion, the cavity comprising:

a face side wall comprising a portion of the backface;

a rear side wall opposite the face side wall, the rear side wall comprising a recess extending from the heel region to the toe-region;

a bottom wall between the face side wall and the rear side wall; and a width measured from the face side wall to the rear side wall; and an insert received within the cavity;

the insert comprises:

a back surface configured to be adjacent to the rear side wall of the golf club head, a front surface opposite the back surface, a bottom surface, a top surface opposite the bottom surface, a toe-region side, a heel-region side opposite the toe-region side, one or more lips stacked horizontally between the top surface and the bottom surface, and an elastically deformable material;

wherein the bottom surface comprises one or more flex slots;

wherein the one or more flex slots are open from the front surface to the back surface of the insert;

wherein one or more ribs are positioned on the insert back surface or the insert front surface;

wherein the one or more flex slots are compressed prior to the insert being received within the cavity such that when the insert is received in the cavity, the one or more flex slots expands to an original shape, causing the front surface, back surface, and bottom surface of the insert to abut against the face side wall, the rear side wall, and the bottom wall of the cavity, and thereby create a press fit of the insert.

2. The golf club head of claim 1, wherein the insert comprises a top lip;

wherein the top lip protrudes from the insert top surface and extends perpendicular relative to the insert back surface.

3. The golf club head of claim 2, wherein the top lip extends along a toe end of the toe-region side, the face surface, and a heel end of the heel-region side.

4. The golf club head of claim 2, wherein the top lip extends along a toe end of the toe-region side, the back surface, and a heel end of the heel-region side.

5. The golf club head of claim 2, wherein the top lip extends along a toe end of the toe-region side, the front surface, the back surface, and a heel end of the heel-region side.

6. The golf club head of claim 2, wherein the top lip abuts against a top surface of the rear portion and is configured to act as a leverage ledge to allow removal of the insert.

7. The golf club head of claim 1, wherein the insert comprises a mass ranging from 0.5 gram to 36 grams.

8. The golf club head of claim 1, wherein the one or more flex slots comprise a triangular shape.

9. The golf club head of claim 1, wherein the one or more flex shots comprises two flex slots each located between a toe end of the toe-region side and a heel end of the heel-region side;

such that the insert bottom surface is divided into three segments.

10. A golf club head comprising:

a body comprising:

a strikeface at a front of the golf club head;

a backface opposite the strikeface;

a heel-region;

a toe-region opposite the heel-region;

a sole;

a rear portion at a rear of the golf club head; and a cavity located between the backface and the rear portion, the cavity comprising:

a face side wall comprising a portion of the backface;

a rear side wall opposite the face side wall, the rear side wall comprising one or more protrusions extending into a portion of the cavity;

a bottom wall between the face side wall and the rear side wall; and an insert received within the cavity;

wherein:

the insert comprises:

a back surface positioned to be adjacent to the rear side wall of the golf club head; a front surface opposite the back surface positioned to be adjacent to the face side wall of the golf club head;

wherein one or more ribs are positioned on the insert back surface or the insert front surface;

a bottom surface;

a top surface opposite the bottom surface; and an elastically deformable material; and wherein the insert bottom surface further comprises one or more flex slots and one or more lips stacked horizontally between the top surface and the bottom surface;

wherein the one or more flex slots are open from the front surface to the back surface of the insert;

wherein the one or more flex slots are compressed prior to the insert being received within the cavity such that when the insert is received in the cavity, the one or more flex slots expands to an original shape, causing the front surface, back surface, and bottom surface of the insert to abut against the face side wall, the rear side wall, and the bottom wall of the cavity, and thereby create a press fit of the insert.

11. The golf club head of claim 10, wherein the one or more ribs are located on the insert front surface.

12. The golf club head of claim 10, wherein the one or more ribs are located on the insert back surface.

13. The golf club head of claim 10, wherein the one or more ribs are oriented perpendicular to the insert top surface.

14. The golf club head of claim 10, wherein the one or more ribs comprises three or more ribs.

15. The golf club head of claim 14, wherein the one or more ribs are each oriented at different angles relative to the insert top surface.

16. The golf club head of claim 10, wherein the insert comprises a hardness between approximately Shore A 25 to approximately Shore A 35.

17. The golf club head of claim 10, wherein the insert comprises a mass ranging from 0.5 gram to 36 grams.

18. The golf club head of claim 10, wherein the strikeface comprises a thickness ranging from 0.05 inch to 0.20 inch.

19. The golf club head of claim 10, wherein the elastically deformable material of the insert comprises a resin mixed with a powdered metal.

20. The golf club head of claim 19, wherein the insert comprises 1% to 30% powdered metal by volume.

* * * * *